US006934402B2

(12) United States Patent
Croft, III et al.

(10) Patent No.: US 6,934,402 B2
(45) Date of Patent: Aug. 23, 2005

(54) PLANAR-MAGNETIC SPEAKERS WITH SECONDARY MAGNETIC STRUCTURE

(75) Inventors: James J. Croft, III, Poway, CA (US); David Graebener, Carson City, NV (US)

(73) Assignee: American Technology Corporation, San Diego, CA (US)

( * ) Notice: Subject to any disclaimer, the term of this patent is extended or adjusted under 35 U.S.C. 154(b) by 314 days.

(21) Appl. No.: 10/075,936

(22) Filed: Jan. 25, 2002

(65) Prior Publication Data

US 2002/0118856 A1 Aug. 29, 2002

Related U.S. Application Data

(60) Provisional application No. 60/264,474, filed on Jan. 26, 2001.

(51) Int. Cl.[7] ..... H04R 25/00

(52) U.S. Cl. ..... 381/412; 381/399; 381/191

(58) Field of Search ..... 381/113, 116, 381/174, 176, 399, 423, 426–428, 190–191, 412, 431; 181/167–170, 173–174

(56) References Cited

U.S. PATENT DOCUMENTS

| | | | |
|---|---|---|---|
| 1,799,053 | A | 3/1931 | Mache |
| 1,951,669 | A | 3/1934 | Ramsey |
| 2,461,344 | A | 2/1949 | Olson |
| 2,855,467 | A | 10/1958 | Curry |
| 2,935,575 | A | 5/1960 | Bobb |
| 2,975,243 | A | 3/1961 | Katella |
| 3,008,013 | A | 11/1961 | Williamson et al. |
| 3,012,222 | A | 12/1961 | Hagemann |
| 3,013,905 | A | 12/1961 | Gamzon et al. |
| 3,136,867 | A | 6/1964 | Bretell |
| 3,209,084 | A | 9/1965 | Gamzon et al. |
| 3,345,469 | A | 10/1967 | Rod |
| 3,373,251 | A | 3/1968 | Seeler |
| 3,389,226 | A | 6/1968 | Peabody |
| 3,398,810 | A | 8/1968 | Clark, III |

(Continued)

FOREIGN PATENT DOCUMENTS

| | | |
|---|---|---|
| JP | H2-265400 | 10/1990 |
| WO | WO 01/08449 | 2/2001 |
| WO | WO 01/52437 | 7/2001 |

OTHER PUBLICATIONS

Ultrasonic Ranging System by Polaroid Corporation.
Parametric Loudspeaker—Characteristics of Acoustic Field and Suitable Modulation of Carrier Ultrasound, Aoki, Kenichi, Kamakura, Tomoo and Kumamoto, Yoshiro, Electronics and Communications in Japan, Part 3, vol. 74, No. 9, pp. 76–82 (1991).

(Continued)

*Primary Examiner*—Curtis Kuntz
*Assistant Examiner*—Phylesha L Dabney
(74) *Attorney, Agent, or Firm*—Thorpe North & Western LLP

(57) ABSTRACT

A planar magnetic transducer having enhanced magnetic structures which increases performance over a single-ended device but mitigates some of the drawbacks of double ended devices, including a supporting structure, a diaphragm incorporating a coil conductor at least a primary magnetic structure, and a secondary magnetic structure can be added, including mitigation of high frequency resonance and attenuation by providing a more open architecture, including spacing the magnets wider apart, configuring the inter-magnet spaces to provide better acoustic performance, using high-energy magnets, which magnets can be shaped to form at least a part of the shaped inter-magnet space.

47 Claims, 16 Drawing Sheets

U.S. PATENT DOCUMENTS

| | | | |
|---|---|---|---|
| 3,674,946 | A | 7/1972 | Winey |
| 3,787,642 | A | 1/1974 | Young, Jr. |
| 3,829,623 | A | 8/1974 | Willis et al. |
| 3,833,771 | A | 9/1974 | Collinson |
| 3,836,951 | A | 9/1974 | Geren et al. |
| 3,873,784 | A | 3/1975 | Doschek |
| 3,892,927 | A | 7/1975 | Lindenberg |
| 3,919,499 | A | 11/1975 | Winey |
| 3,941,946 | A | 3/1976 | Kawakami et al. |
| 4,056,742 | A | 11/1977 | Tibbetts |
| 4,064,375 | A | 12/1977 | Russell et al. |
| 4,160,882 | A | 7/1979 | Driver |
| 4,207,571 | A | 6/1980 | Passey |
| 4,210,786 | A | 7/1980 | Winey |
| 4,245,136 | A | 1/1981 | Krauel, Jr. |
| 4,284,921 | A | 8/1981 | Lemonon et al. |
| 4,295,214 | A | 10/1981 | Thompson |
| 4,338,489 | A | 7/1982 | Gorike |
| 4,378,596 | A | 3/1983 | Clark |
| 4,385,210 | A | 5/1983 | Marquiss |
| 4,418,404 | A | 11/1983 | Gordon et al. |
| 4,419,545 | A | 12/1983 | Kuindersma |
| 4,429,193 | A | 1/1984 | Busch-Vishniac et al. |
| 4,434,327 | A | 2/1984 | Busch-Vishniac et al. |
| 4,439,642 | A | 3/1984 | Reynard |
| 4,468,530 | A | 8/1984 | Torgeson |
| 4,471,172 | A | 9/1984 | Winey |
| 4,480,155 | A | 10/1984 | Winey |
| 4,527,017 | A | 7/1985 | Kopinga et al. |
| 4,558,184 | A | 12/1985 | Busch-Vishniac et al. |
| 4,593,160 | A | 6/1986 | Nakamura |
| 4,593,567 | A | 6/1986 | Isselstein et al. |
| 4,672,591 | A | 6/1987 | Breimesser et al. |
| 4,695,986 | A | 9/1987 | Hossack |
| 4,703,509 | A | 10/1987 | Kanchev |
| 4,751,419 | A | 6/1988 | Takahata |
| 4,803,733 | A | 2/1989 | Carver et al. |
| 4,823,908 | A | 4/1989 | Tanaka et al. |
| 4,885,781 | A | 12/1989 | Seidel |
| 4,887,246 | A | 12/1989 | Hossack et al. |
| 4,888,086 | A | 12/1989 | Hossack et al. |
| 4,903,703 | A | 2/1990 | Igarashi et al. |
| 4,908,805 | A | 3/1990 | Sprenkels et al. |
| 4,939,784 | A | 7/1990 | Bruney |
| 4,991,148 | A | 2/1991 | Gilchrist |
| 5,003,609 | A | 3/1991 | Muraoka |
| 5,003,610 | A | 3/1991 | Adachi et al. |
| 5,054,081 | A | 10/1991 | West |
| 5,142,511 | A | 8/1992 | Kanai et al. |
| 5,153,859 | A | 10/1992 | Chatigny et al. |
| 5,287,331 | A | 2/1994 | Schindel et al. |
| 5,297,214 | A | 3/1994 | Bruney |
| 5,357,578 | A | 10/1994 | Taniishi |
| 5,392,358 | A | 2/1995 | Driver |
| 5,430,805 | A | 7/1995 | Stevenson et al. |
| 5,487,114 | A | 1/1996 | Dinh |
| 5,638,456 | A | 6/1997 | Conley et al. |
| 5,700,359 | A | 12/1997 | Bauer |
| 5,850,461 | A | 12/1998 | Zelinka |
| 5,901,235 | A | 5/1999 | Thigpen et al. |
| 5,953,438 | A | 9/1999 | Stevenson et al. |
| 5,961,762 | A | 10/1999 | Zelinka et al. |
| 6,154,557 | A | 11/2000 | Montour et al. |

OTHER PUBLICATIONS

Parametric Acoustic Nondirectional Radiator, Makarov, et al, Acustica, vol. 77, pp. 240–242 (1992).

The Audio Spotlight: An Application of Nonlinear Interaction of Sound Waves to a New Type of Loudspeaker Design, Yoneyama, et al, J. Acoustical Society of America 73(5), May 1983, pp. 1532–1536.

Electrostatic Loudspeaker Loudspeaker Design and Construction, Chapters 4 and 5, pp. 59–91, Wagner, Ronald, Audio Amateur Press Publishers, 1993.

MMPA. Standard Specifications for Permanent Magnet Materials. MMPA Standard No. 0100–00. 1964.

PLANAR-MAGNETIC SPEAKERS WITH SECONDARY MAGNETIC STRUCTURE

This application is based on, and claims priority of U.S. Provisional Application Ser. No. 60/264,474 filed Jan. 26, 2001.

BACKGROUND OF THE INVENTION

1. Field of the Invention

The present invention relates generally to improvements in planar-magnetic speakers. More particularly, the invention relates to magnetic circuit configurations for single-ended and double-ended devices.

2. Background

Two general fields of loudspeaker design comprise (i) dynamic, cone devices and (ii) electrostatic thin-film devices. A third, heretofore less-exploited area of acoustic reproduction technology is that of thin-film, fringe-field, planar-magnetic speakers.

This third area represents a bridging technology between these two previously recognized areas of speaker design; combining a magnetic motor of the dynamic/cone transducer with the film-type diaphragm of the electrostatic device. However, it has not heretofore produced conventional planar-magnetic speakers, which, as a group, have achieved a significant level of market acceptance over the past 40-plus years of evolution. Indeed, planar-magnetic speakers currently comprise well under 1% of the total loudspeaker market. It is a field of acoustic technology which has remained exploratory, and embodied in only a limited number of relatively high-priced commercial products over this time period.

As with market acceptance of any speaker, competitive issues are usually controlling. In addition to providing performance and quality, a truly competitive speaker must be reasonable in price, practical in size and weight, and must be robust and reliable. Assuming that two different speakers provide comparable audio output, the deciding factors in realizing a successful market penetration will usually include price, convenience, and aesthetic appearance. Price is obviously primarily a function of market factors such as cost of materials and cost of assembly, perceived desirability from the consumer's standpoint (as distinguished from actual quality and performance), demand for the product, and supply of the product. Convenience embodies considerations of adaptation of the product for how the speaker will be used, such as mobility, weight, size, and suitability for a customer-desired location of use. Finally, the aesthetic aspects of the speaker will be of consumer interest; including considerations of appeal of the design, compatibility with decor, size, and simply its appearance in relation to the surroundings at the point of sale and at the location of use. If planar-magnetic speakers can be advanced so as to compare favorably with conventional electrodynamic and electrostatic speakers in these areas of consideration, further market penetration can be possible, as reasonable consumers should adopt the product that provides the most value (bearing in mind the aforesaid factors, for example) for the purchase price paid.

A discussion of the relative successes and failures of conventional planar-magnetic speakers, and design goals and desired traits of operation will be set forth. It is interesting to note that the category of fringe-field, planar-magnetic speakers has evolved around two basic categories: single-ended; and, symmetrical double-ended designs, the latter sometimes being called "push-pull."

A conventional double-ended, or push-pull, device is illustrated in FIG. 1. This structure is characterized by two magnetic arrays 10 and 11 supported by perforate substrates 14, 24 positioned on opposite sides of a flexible diaphragm 12, which includes a conductive coil 13. The film is tensioned into a planar configuration. An audio signal is supplied to the coil 13, and a variable voltage and current thereby provided in the coil gives rise to a variable magnetic field, which interacts with the fixed magnetic field set up by and between the magnet arrays 10 and 11. The diaphragm is displaced in accordance with the audio signal, thereby generating a desired acoustic output. An example representing this art area is found in U.S. Pat. No. 4,156,801 issued to Whelan.

Because of a doubled-up, front/back magnet layout of the prior art push-pull magnetic structures, double-ended systems have been generally regarded as more efficient, but also as more complex to build. Also, they have certain performance limitations stemming from the formation of cavity resonances arising from passage of sound waves through cavities or channels 16 formed by the spacing of the magnets of the magnet arrays 10,11 and the holes 15 in the substrates 14, 24. This can cause resonant peaks and band-limiting attenuation at certain frequencies or frequency ranges.

Double-ended designs are also particularly sensitive to deformation from repulsive magnetic forces that tend to deform the devices outward. Outward bowing draws the edges of the diaphragm closer together, and alters the tension of the diaphragm. This can seriously degrade performance; and, over time, can render the speaker unusable.

As mentioned, another category of planar-magnetic speakers comprises single-ended devices. With reference to FIG. 2, a typical conventional single-ended speaker configuration, having a flexible diaphragm 17 with a number of conductive elements 18, is illustrates prior art design. The diaphragm is tensioned and supported by frame members (not shown) carried by a substrate 19 of the frame, which frame extends outward and upward in the figure beyond a single array of magnets 20 to position the diaphragm a gap or offset distance away from the faces (tops in the figure) of the magnets to accommodate vibration of the diaphragm. The magnet array provides a fixed magnetic field with respect to coil conductors 18 disposed on the diaphragm. It will be apparent that the single array of magnets (typically of ceramic or rubberized ferrite composition) provides a much-reduced energy field compared with previously-discussed push-pull devices, assuming comparable magnets are used. Previous single-ended devices of compact size have generally not been deemed acceptable for commercial applications.

Conventional single-ended devices have had to be quite large to work effectively; and even so, were less efficient than standard electrostatic and electro-dynamic cone-type loudspeaker designs mentioned above. Small, or even average-sized single-ended planar-magnetic devices (compared to standard sizes of conventional speakers) have not effectively participated in the loudspeaker market in the time since introduction of planar-magnetic speakers. Very large devices, generally greater than 300 square inches, have been available to the consumers in the speaker market; and these exhibit limited competitiveness. That is to say, they are on par with standard speakers in terms of acceptance, suitability for certain applications, cost, and performance. But again, prior single-ended planar-magnetic devices with such large diaphragm areas require correspondingly relatively large, expensive structures; and, such relatively large speakers can be cumbersome to place in some domestic environments. They have relatively low efficiencies as well, compared with conventional electrostatic and dynamic transducers, requiring more powerful, and hence more expensive, amplifiers to provide adequate signal strength to drive them.

At first impression, a single-ended device might appear to be simpler and cheaper to build than a double-ended design. The same amount of magnet material can be used by doubling the thickness of the magnets to correspond to the combined thickness of a double-ended array of magnets. Because magnets which are twice as thick are cheaper than twice as many magnets half as thick in a double-ended device, there should be significant savings in a single-ended configuration. Furthermore, the structural complexity is significantly less with regard to single-ended designs, further adding to expected cost savings.

However, doubling the depth of the magnets from that of most designs does not achieve the desired design goal of providing twice the magnetic energy in the gap between the diaphragm and the array of magnets using conventional ferrite magnets used in prior planar-magnetic devices. Accordingly, the expectation for lower cost and better performance in the single-ended device has not been realized. Some attempts to improve the design of single-ended planar-magnetic devices have involved the use of many, very closely spaced, magnets, to have high enough magnetic energy. Even then, however, the planar area must be very large, using even more magnets to generate enough sensitivity and acoustic output. For at least these reasons, prior attempts to develop a commercially acceptable single-ended planar-magnetic device have not achieved the desired lower-cost design goals. This is true even though the basic form of their structure would seem to be simpler than push-pull devices.

The architecture of the double-ended planar-magnetic loudspeaker is quite different from that of a single-ended design. For example, the magnetic circuits of the front and back magnetic structures interact, and require a different set of parameters, spacing, and relationships between the essential elements to be optimized, for best results. This double-ended magnetic relationship causes greater repulsion forces, making it more difficult to have a stable mechanical structure, but also gives a more focused field, which can make for better utilization of magnetic material. Very few of those interactive relationships are transferable in relation to design of single-ended transducers, which have their own unique set of optimal relationships between the essential elements involved.

As mentioned, prior planar-magnetic speakers, particularly prior art single-ended devices, have utilized rows of magnets placed closely, side by side. The magnets are oriented with alternating polarities facing the film diaphragm, which includes conductive wires or strips 18 substantially centered between the magnets. Such prior devices further illustrate that the magnet energy to be captured by the conductive strips is a shared magnetic field with lines of force arching between adjacent magnets. In such prior devices, the magnetic force is assumed to be at a maximum at a point halfway between two adjacent magnets of opposite polarity orientation and, correspondingly, centered placement of the conductive strips in the field at that location is typical. To achieve this maximized flux density at the position centered between the magnets, it has been shown that (i) not only does the total size of the system need to be increased; but, (ii) the magnet placement must be much closer together and more plentiful in a single-ended device than in a push-pull planar-magnetic transducer.

Further, in contrast with standard, dynamic cone-type speakers, thin film planar loudspeakers have a critical parameter that must be optimized for proper functionality. The parameter is film diaphragm tension. (See, for example, U.S. Pat. No. 4,803,733) Proper, consistent and long-term stable tensioning of the diaphragm in a planar device is very important to the performance of the loudspeaker. This has been a problematic area for thin-film planar devices for many years, and it is a problem in the design and manufacture of current thin-film devices. Even the most carefully adjusted device can meet short-term specification requirements, but can still have long-term problems with tension changes due to the dimensional instability of the diaphragm material and/or diaphragm mounting structure. Compounding this problem is force interaction within the magnet array structure. Due to close magnet spacing of single-ended magnetic structures, the magnetic forces generated by adjacent rows of magnets can interact and attract/repel each other to a greater or lesser degree, depending upon factors such as the inter-magnet spacing and polarity relationship of the magnets. This interaction, over time, can cause materials to deform; and can impose changes on the film tension. This can degrade the performance of the speakers over time. Electrostatic loudspeakers have critical diaphragm tension issues, but they do not have relatively large magnetic forces working to change the tension in the same way or to the same degree. Dynamic cone-type speakers have magnetics and strong related forces, but generally do not utilize tensioned diaphragms. Planar-magnetic speakers pose unique challenges with respect to long-term stability for diaphragm tensioning.

With conventional planar-magnetics an increase in magnetic energy derived by increasing the number, or the strength, or both, of the magnets in the magnetic structure further exacerbates the problem of magnetic forces interference with calibrated film tension. Per the foregoing, this is true particularly over time. These and other problems are known in the art. An example of a prior art single-sided planar-magnetic device is set forth in U.S. Pat. No. 3,919,499 to Winey.

Turning now more particularly to consideration of the magnets themselves, the selection of proper magnets for planar-magnetic speakers is an important consideration. High-energy neodymium magnets have been available for over ten years, and have been used in electrodynamic cone-type speakers. As will be appreciated, however, such speakers do not employ magnetic materials structures, and supporting structures to support the magnets; and, at the same time, maintain a tension on the diaphragm that can be influenced by deformation, which can, in turn, be caused by the magnets. Such relatively more high-energy neodymium magnets have not been effectively applied to single-ended planar-magnetic transducers over this past decade, although they have been widely available. This is true even though there has been a great need for an improved magnetic circuit to enhance speaker output and reduce size.

With current magnetic structure designs having very close side-to-side spacing, a perceived problem with high-energy magnets is that the attractive forces would appear to be too intense, to a point of not only potentially distorting the supporting structure and affecting diaphragm tension, but even affecting stability of existing magnet attachment means. For these and other reasons such high-strength magnets have not been used in commercial conventional planar-magnetic transducer design.

As mentioned, particularly with double-ended devices, cavity resonances and other distortion problems arise due to the narrow channels between magnets, radiating to the outside through holes in the support structure. Single-ended devices, particularly where the magnet spacing is close, and the cavities between the magnets is relatively deep and narrow, also have been subject to distortions, particularly at the high and low frequency portion of their performance envelope. At least in part, this is also due to the close spacing of the magnets in prior devices, with attendant band limiting attenuation and resonances arising from the geometry of the cavities and holes through the supporting structure.

Also important is the magnetic circuit configuration and its relationship to the diaphragm conductive regions. The maximization of the interaction between coil and magnetic structure is key to gaining better efficiency, and can improve response, particularly at lower frequencies. Also, thermal and dimensional stability of the diaphragm material is important to performance, particularly over a long time of product use. Likewise the incorporation of the coil in or on the diaphragm is important. If the coil conductors de-bond, develop an open circuit (for example by fatigue failure), speaker performance is compromised. With both single- and double-ended devices, other considerations apply, but these give some background as to the design challenges faced. Single-ended and double-ended devices both have drawbacks and advantages relative to each other and overall both have previously been perceived to have both advantages and disadvantages compared with conventional electrostatic and electrodynamic cone-type devices. However, both single- and double-ended planar-magnetic transducers have continued to lag behind conventional cone type and electrostatic speakers in maximizing the use of magnetic drive and finding commercial acceptance.

In summary, heretofore neither conventional double-ended or single-ended designs of planar-magnetic loudspeakers have reached a stage of development which enables them to be competitive with speakers of the first two types discussed above (dynamic and electrostatic), the latter previously having higher efficiencies and lower manufacturing costs. This lack of market success, due at least in part to the reasons set out above, has continued over a period of more than 40 years.

SUMMARY OF THE INVENTION

The invention provides a planar-magnetic transducer comprising at least one thin-film vibratable diaphragm with a first surface side and a second surface side, including an active region, said active region including a coil having at least one conductive area configured for interacting with a magnetic structure for converting an electrical input signal to a corresponding acoustic output; and, a primary magnetic structure including at least one elongated high energy magnet having an energy product of greater than 25 mega Gauss Oersteds. The magnet can be greater than 34 mGO and can comprise neodymium. The transducer further comprises a mounting support structure coupled to the primary magnetic structure and the diaphragm, to capture the diaphragm, and hold it in a predetermined state of tension. The diaphragm is also spaced at a distance from the primary magnetic structure adjacent one of the surface sides of the diaphragm. The conductive surface area includes one or more elongate conductive paths running substantially parallel with said magnets. The mounting support structure, and the multiple magnets of the magnetic structure, and the diaphragm, have coordinated compositions and are cooperatively figured and positioned in predetermined spatial relationships, wherein the configurations of the magnetic relationships provide performance and/or cost/performance ratios that are improved over the prior art single ended or double ended planar-magnetic devices.

The transducer can further comprise a secondary magnetic structure which cooperates with the primary magnetic structure and the conductive area to enhance performance. The transducer can further include virtual poles, magnets of different energy configured to maximize use of magnetic energy made available. Energy can be maximum at a central portion of the transducer and decrease with lateral distance outward from the center. The gap between the magnets and the diaphragm can be varied to accommodate diaphragm movement and maximize field interaction at the same time. The secondary magnetic structure can be carried by support structure having a more open architecture to more freely accommodate sound passage, thereby improving response, particularly at high frequencies. The magnets and supporting structure can be shaped and configured to provide flaring, or horn-shaped cross sectional inter-magnet spaces, which provides improved linearity of response at high frequencies.

Magnetic structures are disclosed that create more effective use of magnetic energy distribution within the transducer, including enhanced single-ended or Quasi-push-pull structures, asymmetrical mounted magnetic structures, ferrous magnetic return paths to enhance the magnetic energy with in the structure while using fewer magnets, and re-orientation of magnets in terms of their relation ship to the diaphragm and to each other. Other inventive features will also be appreciated with reference to the following detailed description, taken in conjunction with the accompanying drawings, which together and separately illustrate, by way of example, features of the invention.

As specific examples, some of these novel magnetic structures and formats include:

- Quasi push-pull, enhanced single-ended magnetic structures with one or more secondary magnets on the opposite side of the diaphragm from a primary single ended magnetic structure. These are arranged to have variations in working magnetic field energy with distance from the central magnet, variations in magnetic count on the primary surface side of the diaphragm vs. the secondary surface side of the diaphragm, a mixture of virtual magnetic poles derived from back iron return paths combined with actual magnetic poles of magnets; i.e., ferrous magnetic return path/magnet hybrids and/or front-to-back offset ferrous magnetic return path magnetic circuit with virtual magnets in a single ended or quasi-push pull device
- Virtual magnetic, return path poles—single ended, hybrid, or offset push-pull with return flux on outside edges of transducer for lightly driven diaphragm control.
- Magnets rotated to a 90 degrees orientation, i.e.; each magnet oriented with a side by side north/south pole in single-ended, double-ended, and hybrid 0 and 90 degree combinations with one magnet substantially simulating and replacing two separate magnets.
- One magnet row neodymium planar magnet transducer system single or double ended with a supplemental virtual pole that is spaced closer to the diaphragm than the magnets themselves.
- Inside out single ended planar-magnetic transducer with two diaphragms straddling a single magnet structure, with magnet to diaphragm spacing and/or field strength changes with distance from center and further with optional, magnetic push-pull tweeter integration
- Coaxial variations of tweeter integration into low frequency planar diaphragm—can be single ended low frequency unit with partial or complete, double ended tweeter, integrated into or onto larger lower frequency device. Corner, end, or side would be preferable placement, but center mount can also be effective.

DETAILED DESCRIPTION

Figure 1:
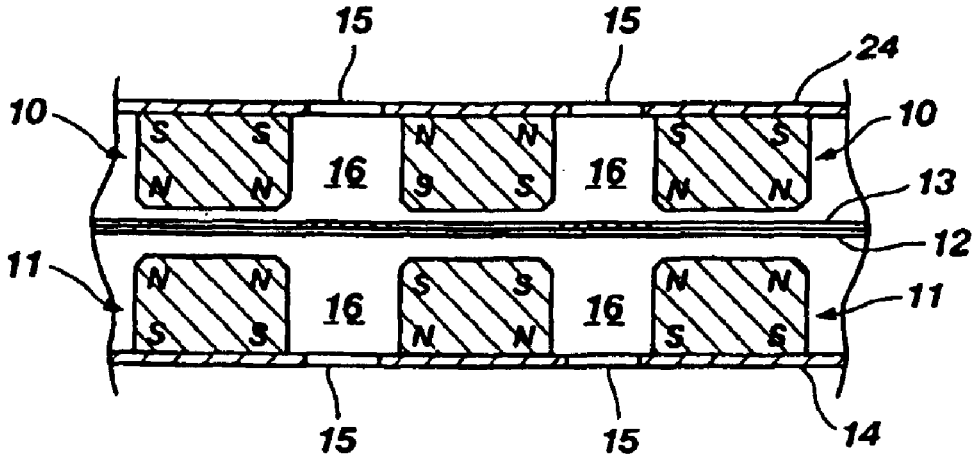
Fig. 1 (PRIOR ART)
FIG. 1 is a cross-sectional fragmentary view of an exemplary prior push-pull planar-magnetic transducer with a double-ended magnetic structure.
Figure 2:
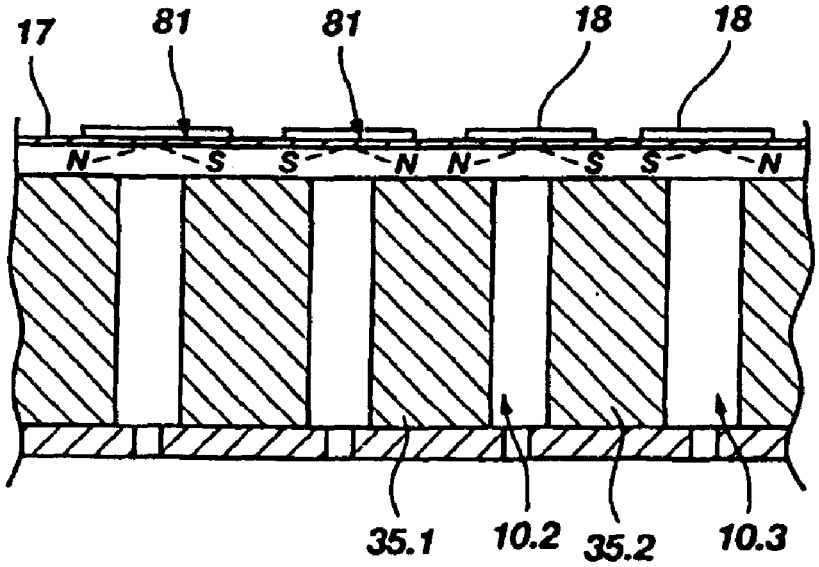
Fig. 2 (PRIOR ART)
FIG. 2 is a cross-sectional fragmentary view of an exemplary prior art single-ended planar-magnetic transducer.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended.

Figure 3:
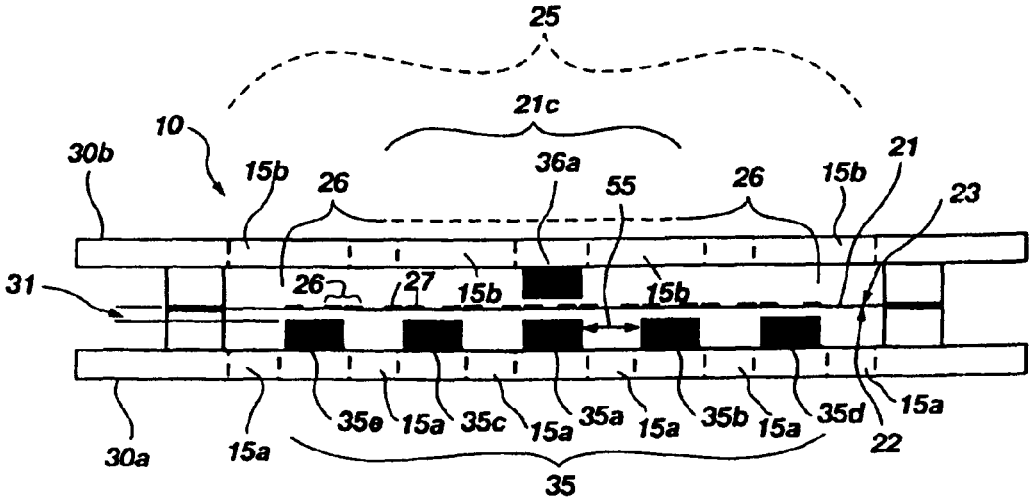
FIG. 3 is a cross-sectional view of an exemplary magnetically enhanced single-ended planar-magnetic transducer in accordance with principles of the invention.

With reference to FIG. 3, an inventive concept that can be quite valuable, particularly when optimizing high energy magnets 35, 36 in planar-magnetic transducers 10, is that of increasing magnetic energy over the centralized portion 21*c* of the diaphragm. Putting more magnet volume there, it has been found, can provide surprisingly more gain in efficiency for a given increase in magnetic material than what is expected from conventional understanding and application of magnetic theory, and its relationship to electromagnetic transducers. Conventionally it is understood that by increasing total magnetic energy in a transducer by about 41%, about 3 decibels increase in efficiency will be provided. It has been found by the inventors that when just the magnetic energy over a central portion 21*c* of the diaphragm 21 is doubled, or doubling the energy on a central row of magnets 35*a* in a 5 magnet row system 35 by adding a magnet centered in a secondary magnet row 36*a,* a three decibel sensitivity increase is available in a planar-magnetic transducer. In the illustrated embodiment this is an increase of only 20% of the total magnetic energy, or less than half the theoretical amount, to achieve this 3 dB level of efficiency increase. This characteristic is unique to tensioned-diaphragm transducers which have the ability to deflect the diaphragm much more easily in the center, as compared to suspended cone type transducers, which have substantially constant deflection in the direction of cone movement across the total movable cone diaphragm surface.

Therefore, by organizing the magnetic force available so as to be greatest in the plane of the diaphragm 21 in the center of the transducer 10, e.g. over a central magnet 35*a* in the illustrated embodiment, and having less energy laterally in the outermost regions (i.e. over magnets 35*d* and 35*e*), the best use of magnetic energy is provided. This can allow the cost of the magnets to be less for a given acoustic efficiency. Or, put another way, for a given cost of total magnetic mass, this embodiment can provide greater transducer efficiency.

This center concentration of available energy approach can, of course, be used with different combinations of magnets of greater count than one, and can be distributed; for example, wherein just the outermost magnets are of less energy, or any combination of all magnets other than the central magnet 35*a,* can be of falling energy with lateral distance from the central-most region of the transducer. Alternatively, one can take advantage of this concept by increasing the magnetic energy over the centralized portion of diaphragm, relative to magnets over a non-centralized portion of the diaphragm in a planar-magnetic transducer.

This concept takes advantage of the fact that during its active state the vibratable diaphragm 21 exhibits more ready displacement and freedom of movement in the central region 21*c* than at all regions away from the central region particularly when producing high outputs at the lower frequency range of the device, where the greatest diaphragm movements are required. This is realized to be due to the mechanical advantage obtained by driving the diaphragm most forcefully in the center, where it can resist displacement the least. With this in mind, one can construct a device having closer magnet face to diaphragm gap distance 31 and create more effective magnetic coupling with less magnetic field strength laterally towards the outer portions of the transducer 10 without reaching diaphragm excursion limits.

This concept of central augmentation of magnetic field energy available for coupling by the coil conductors 27 of the conductive areas 26 of the diaphragm 21 is particularly effective when combined with the concept of using higher-energy magnets, such as those having an energy of over 25 mGO, and even about 34 mGO or more. The inventors have found that going in a contrary direction from bringing the magnets closer together to increase the shared field strength between magnets, as is done in prior devices, by spreading the magnets apart, increasing their energy, and maximizing use of local loop energies, increases in various efficiencies allows a more effective device to be constructed. Further details of this design philosophy, its implementation, and advantages obtained, can be found in co-pending U.S. patent application Ser. No. 10/055,821, which is hereby incorporated by reference for the supporting teachings of that disclosure. While dealing primarily with single-ended designs, the aforementioned design direction has applicability beyond single-ended devices, as will be appreciated with reference to this disclosure.

While FIG. 3 shows one embodiment having five rows of primary magnets in a primary magnetic structure 35 and one secondary magnet 36*a* in a secondary magnetic structure 36, the number of magnets, the gap spacing, and the relative positions of conductors 27 of conductive coil areas 26 to the magnets, as well as the inter-magnet spacing 55 can be varied within compliance with certain operative principles which will be discussed herein. For example, this basic architecture could be implemented with just three rows of primary magnets, and it has been found that a transducer in accordance with this disclosure achieves the highest performance with at least three rows of magnets 35*a,* 35*b,* and 35*c*. It is found that by using odd numbers of rows of magnets, the conductive areas or regions 26, and the other elements can be formed to work together to operate more efficiently and provide lower costs for a given output, generally speaking. Therefore, preferably three, five, and seven or more odd numbers of primary magnet rows are used in the primary magnetic structure 35.

The present invention can also be viewed as a method for enhancing the operation of a single-ended planar-magnetic transducer 10 which utilizes a thin-film diaphragm 21 with a first surface side 22 and a second surface side 23 that includes a conductive region 26 comprising at least one conductor configured to carry an electric audio signal. The diaphragm is positioned and spaced from a primary magnetic structure 35 and secondary magnet structure 36 including high energy magnets, at least 35*a,* 35*b* and 35*c,* of greater than 25 mGO, and in another embodiment are preferably greater than 34 mGO, and composed of a material or materials including neodymium. An enhanced functionality of the transducer 10 is obtained over long term use, the calibration being maintained over that time. The calibration maintained by this method relates to (i) proper spacing 55 between the magnets 35*a* through 35*e,* (ii) magnet to diaphragm spacing 31, and (iii) proper diaphragm 21 tension over a long term. The diaphragm has an acoustomechanically active area (active area) 25 that is mobilized by forces arising to act on the conductive region to produce acoustic output when the conductive runs 27 of conductive region 26 receive and carry a varying current/power of an audio signal. The coil conductors 27 are configured to cooperate with the magnet rows to drive the diaphragm in a vibratory motion, and thereby produce an audio output which the transducer is adapted to receive in electronic form and reproduce in mechanical audio wave form in air.

An exemplary embodiment of the transducer invention of FIG. 3 comprises:

Diaphragm:

- Material: Kaladex[a] PEN (polyethylenenaphthalate) film
- Dimension: 0.001" thick, 2.75" wide by 6.75" long
- Conductor adhesive: Cross-linked polyurethane—5 microns thick
- Conductor soft alloy aluminum foil layer 17 microns thick
- Aluminum conductive pattern as per FIG. 20
  Resistance of conductive path=3.6 ohms
- CP Moyen polyvinylethelene damping compound applied to outer portions of the diaphragm
- Coil pattern: four coil "turns" per inner gap(s)
- Conductor width=0.060"
- Space between conductor in each pair=0.020"

Mounting support structures: 16 gauge cold rolled steel

- Dimensions: 3" by 8"
- 0.060" felt damping on backside of primary magnet structure
- Mounting structure to film adhesive—80 cps cyanoacrylate
- Magnet to diaphragm gap (31)=0.028"
- Magnet to magnet spacing (55)=0.188"

Magnets:

- Adhesive: catalyzed anaerobic acrylic
- Five primary rows and one secondary row of three magnets each 0.188" wide, 0.090" thick, 2" long (6" total row length)
- Nickel coated Neodymium Iron Boron 40 mega Gauss Oersteds Performance:

- Resonant frequency: 200–230 Hz (adjustable by diaphragm tension)
- High frequency bandwidth: −3 dB@>30 kHz
- Sensitivity: 2.83 volts>95 dB@1 kHz In one embodiment openings 15*b* in the support structure 30*b* supporting the secondary magnetic structure 36 can be made large. This improves (i.e. better linearizes) high-frequency response, as it opens up one side of the transducer to allow less constricted passage of sound waves, decreasing cavity resonances and high frequency attenuation. This advantage of a single-ended device is obtained in a quasi-double-ended device.

Figure 4A:
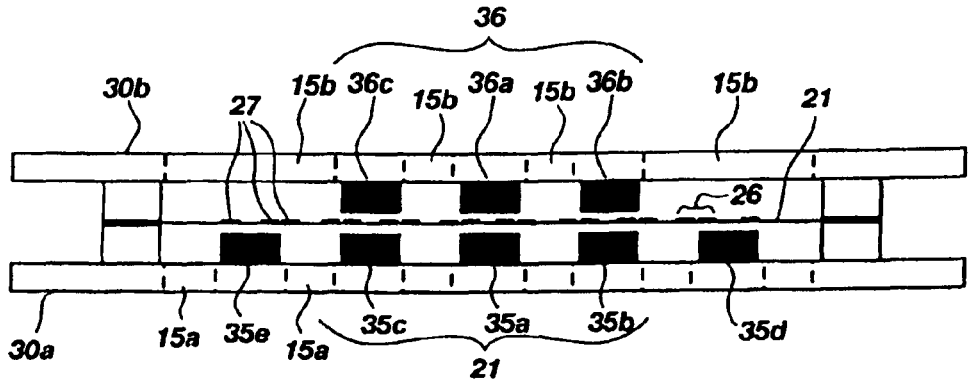
FIG. 4A is cross-sectional view of another exemplary magnetically enhanced single-ended planar-magnetic transducer in accordance with principles of the invention.
Figure 4B:
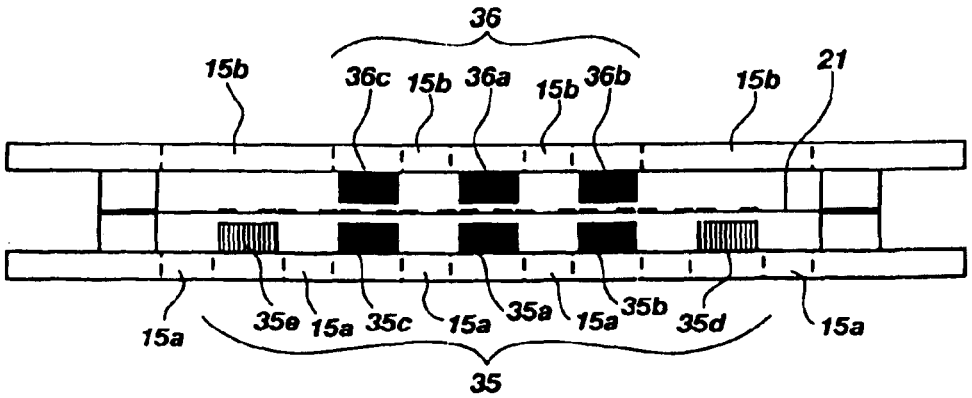
FIG. 4B is a cross-sectional view of another exemplary further magnetically enhanced single-ended planar-magnetic transducer in accordance with principles of the invention with different outermost primary magnet energy.

With reference to FIG. 4A, a similar system to that of the previous figure is illustrated, wherein a secondary magnetic structure 36 is provided having three rows of secondary magnets 36*a,* 36*b,* and 36*c.* These are placed over the central portion 21*c* of the diaphragm 21 to further enhance output, and which does so more effectively than placing the same amount of magnetic material symmetrically all across the diaphragm, as would be done in a symmetrical prior push-pull system as shown in FIG. 1. As with the previously discussed embodiment, the holes 15*b* in FIG. 4B illustrates another embodiment which has a similar basic structure to that of the embodiment of FIG. 4A, but with outermost magnets 35*d* and 35*e* being of reduced magnetic energy. They might be of lower energy, such as more conventional magnets of ceramic ferrite composition; and, the rest of the magnets of magnet structures 35 and 36 would preferably be of higher energy, such as of neodymium compositions having energies of 25 mGO or greater.

Figure 4C:
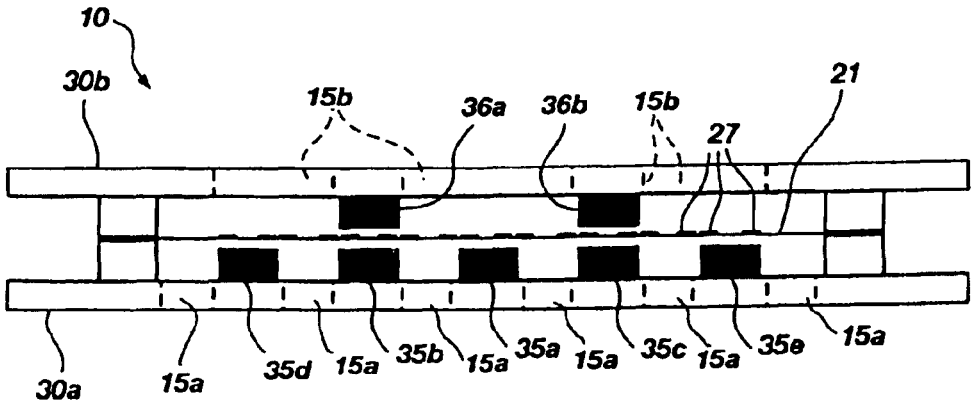
FIG. 4C is a cross-sectional view of another exemplary further magnetically enhanced single-ended planar-magnetic transducer in accordance with principles of the invention with different outermost primary magnet energy.
Figure 4D:
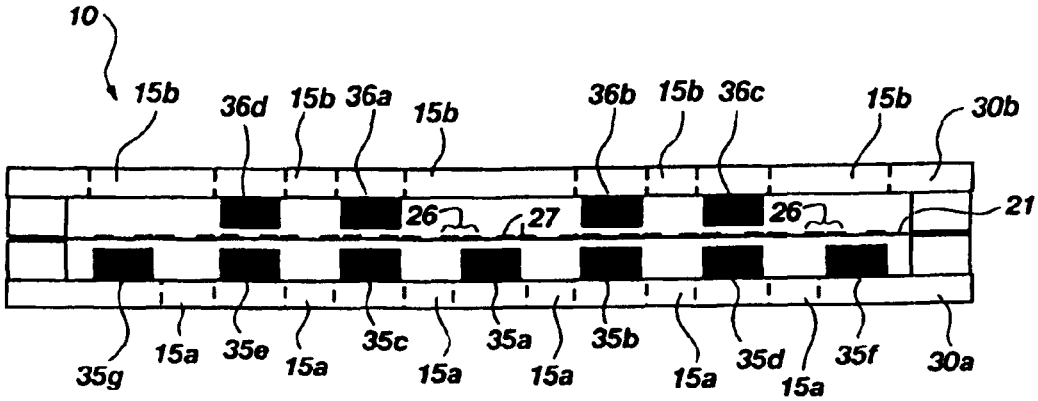
FIG. 4D is a cross-sectional view of another exemplary further magnetically enhanced single-ended planar-magnetic transducer in accordance with principles of the invention with different outermost primary magnet energy.
Figure 4E:
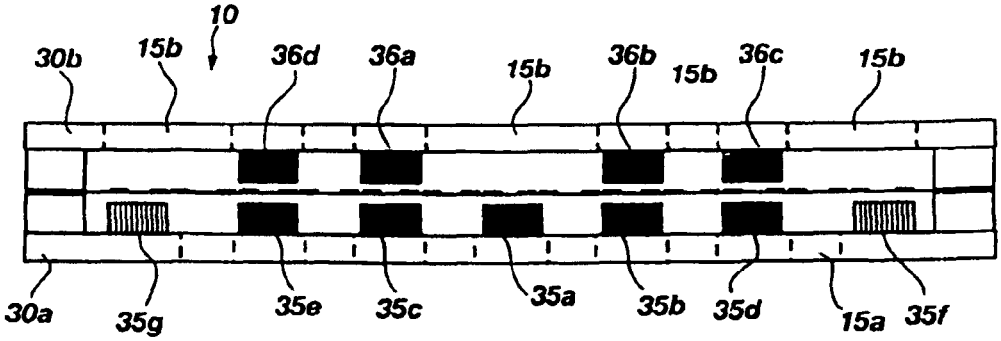
FIG. 4E is a cross-sectional view of another exemplary further magnetically enhanced single-ended planar-magnetic transducer in accordance with principles of the invention with different outermost primary magnet energy.

With reference to FIG. 4C, in another embodiment the transducer 10 can have five magnets 35 *a–e* in the primary magnetic structure 35, and 2 magnets 36*a,* 36*b* in the secondary magnetic structure 36. Again, these are disposed more centrally than the five magnets of the primary structure which is spread laterally wider across the diaphragm. This configuration allows large openings 15*b* to be spread across the secondary support structure 30*b,* including the center-most portion between the two secondary magnets. A Further variation can be appreciated with reference to the illustrated embodiment of FIG. 4*d,* wherein a similar design is applied to a transducer 10 having 7 magnets in the primary magnetic structure, and 4 in the secondary magnetic structure. In another variation illustrated by FIG. 4E, the configuration can be further modified by providing magnets of lower energy at laterally outboard portions of the magnetic structure. For example by providing magnets of the same size, but of lower energy in outer rows; or, by providing magnets of the same energy but of smaller size. In the later embodiment the laterally outboard row(s) of magnets can be mounted on spacers (such provided in other embodiments, as can be seen in FIGS. 5–10) of varying height, so that the gap 31 can be maintained even with that of the central portion 21*c,* or made smaller in the laterally outward row(s).

Figure 5:
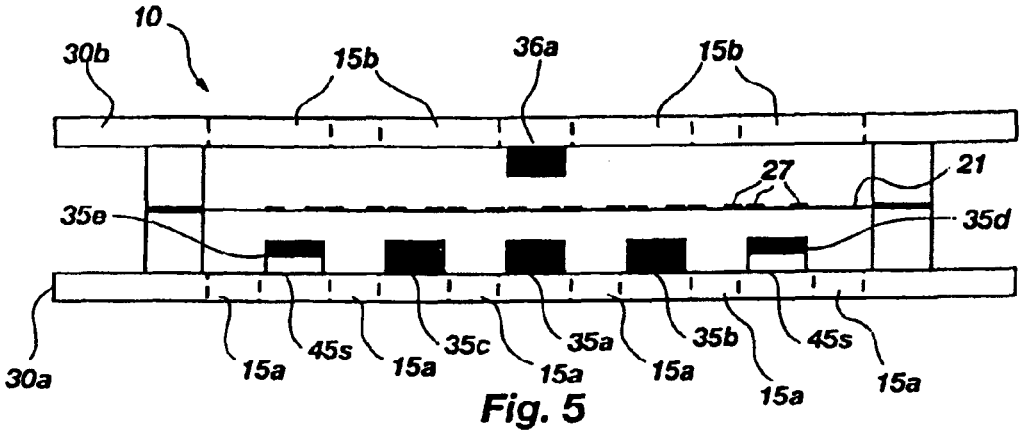
FIG. 5 is a cross-sectional view of an exemplary magnetically enhanced single-ended planar-magnetic transducer in accordance with principles of the invention with smaller primary outer magnets.

Turning now to FIG. 5, it will be appreciated that in this embodiment the planar-magnetic transducer is basically similar to that of FIG. 3, but with the laterally outermost magnets 35*d* and 35*e* of primary magnetic structure 35 being of smaller size and lower energy than the more central magnets 35*a,* 35*b,* 35*c,* and 36*a.* In this embodiment the smaller outermost magnets 35*d* and 35*e* being less powerful than those located more centrally. In one embodiment they are of the same energy as the other magnets (e.g. more than 25 mGO, such as about 35 mGO or more) and are smaller, and are spaced off of support structure 30 by spacer 45*s* to have substantially the same magnet to diaphragm gap 31 as the other magnets. Support structure 30*a* and spacers 45*s* may or may not be made of a magnetically conductive material. In most preferred embodiments a ferrous material use would be preferable, however, as it allows for flux return paths when the magnets are oriented so as to have alternating polarity across the magnetic structure 35*a.* Again, the holes 15*b* in the secondary structure can be made larger to provide a more open structure on the secondary side as discussed above. As in all the embodiments, conductive runs 27 are provided wherein current of an electrical audio signal of variable frequency and amplitude flows and creates fields which interact with the fields set up by the primary and secondary magnet structures 35 and 36 to mobilize the vibratable diaphragm 21 and produce an audio output.

Figure 6:
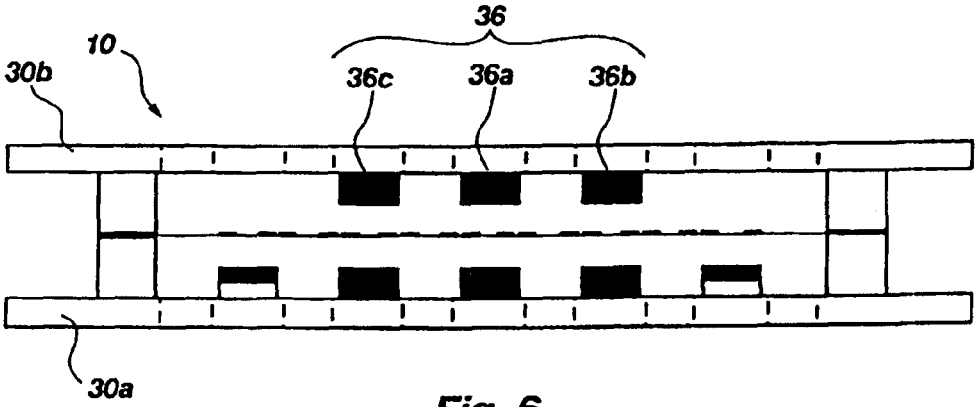
FIG. 6 is a cross-sectional view of an exemplary magnetically enhanced planar-magnetic transducer in accordance with principles of the invention with smaller primary outer magnets.

The planar-magnetic transducer 10 of FIG. 6 is essentially similar to that of the embodiment of FIG. 5 except that a secondary magnetic structure 36 with three rows of secondary magnets 36*a,* 36*b,* and 36*c* replaces the single magnet 36*a* of FIG. 5 and is related in a manner similar to the relationship of the embodiments of FIGS. 3 and 4A discussed above.

Figure 7:
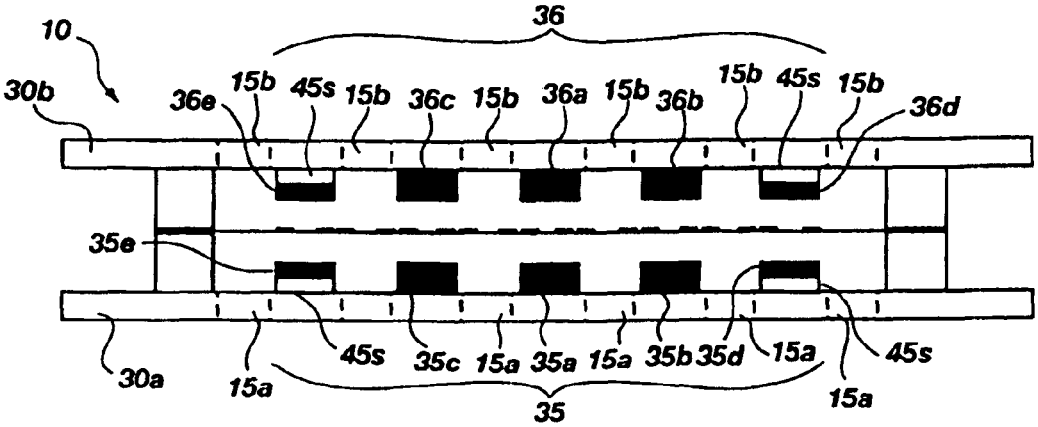
FIG. 7 is a cross-sectional view of another exemplary magnetically enhanced planar-magnetic transducer in accordance with principles of the invention with smaller primary outer magnets.

In the exemplary planar-magnetic transducer 10 embodiment of FIG. 7, a fully complementary primary magnet structure 35 and secondary magnet structure 36 are provided. That is to say, they are symmetrical about vertical and also about horizontal axes. In this embodiment the laterally outermost magnets 35*d* and 35*e* and 36*d* and 36*e* are of smaller size and magnetic field force than the rest of the magnets 35*a* to 35*c* and 36*a* to 36*c*. As in the previously discussed embodiment(s), spacers 45*s* hold the magnets at substantially the same gap 31 as that of the magnets without spacers 45*s* in this embodiment. In another embodiment, the outer magnet row(s) can instead comprise magnets of the same size but of lower energy as discussed above.

Figure 8:
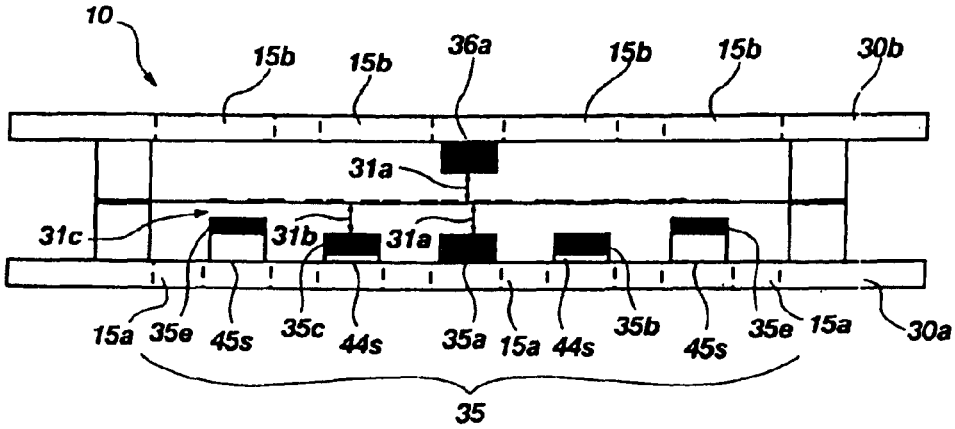
FIG. 8 is a cross-sectional view of an exemplary magnetically enhanced planar-magnetic transducer in accordance with principles of the invention with smaller primary outer magnets and magnetic gaps.

With reference to FIG. 8, in another embodiment the concept of laterally varying field strength with distance from the central region, discussed above, is combined with variation of the gap distance 31 with lateral distance from a central part of the diaphragm. In the illustrated embodiment magnet pairs 35*b*, 35*c*, and 35*d*, 35*e*, of magnet structure 35 are progressively made of lesser energy by using smaller, weaker magnets compared to central magnet 35*a* and also spacing them with spacers 44*s* and 45*s* so that they are progressively closer in diaphragm to magnet gapping; with gaps 31*a*, 31*b*, and 31*c* getting progressively smaller towards the outer edges of transducer 10. This allows larger diaphragm excursions in a central portion 21*c*, and advantageously maximizes the available energy from the magnets of the magnet structure by positioning the weaker magnets closer to the diaphragm. Again, while high-energy magnets are used, and magnet volume is varied in this embodiment, using spacers, 44*s*, 45*s*, lower energy magnets of other sizes could be used as well to provide essentially the same operational configuration. As discussed above, larger holes 15*b* can be provided in the secondary support structure 30*b*, for more linear high frequency response as discussed above.

Figure 9:
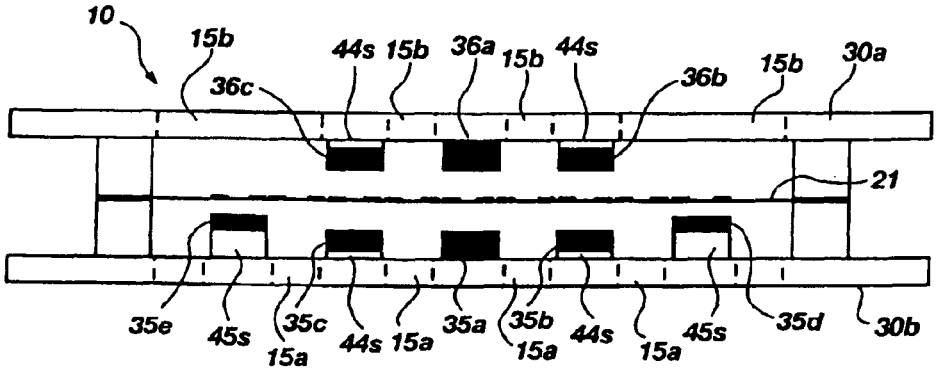
FIG. 9 is a cross-sectional view of another exemplary magnetically enhanced planar-magnetic transducer in accordance with principles of the invention with smaller primary outer magnets and magnetic gaps.

With reference to FIG. 9, in another embodiment the transducer 10 configuration illustrated adds to the single secondary magnet 36*a* of the embodiment shown in FIG. 8, two more secondary magnets 36*b* and 36*c*, smaller/weaker than the secondary magnet 36*a*, and having faces spaced closer to diaphragm 21 by spacers 44*s*. Again, a similar effect can be obtained using magnets of less energy for the additional magnet rows 36*b*, 36*c* lateral to the central magnet 36*a*.

Figure 10:
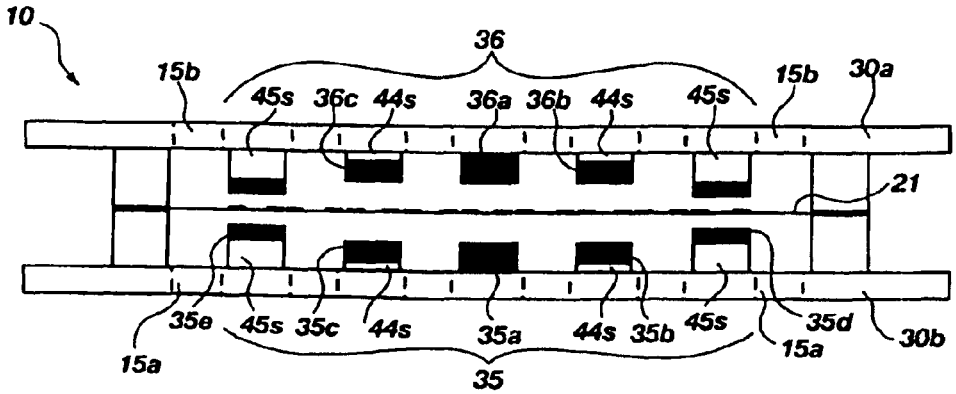
FIG. 10 is a cross-sectional view of still another exemplary magnetically enhanced planar-magnetic transducer in accordance with principles of the invention with smaller primary outer magnets and magnetic gaps.

The transducer 10 embodiment illustrated in FIG. 10 essentially uses the primary magnet structure 35 configuration of FIGS. 8 and 9 and mirrors it in the secondary magnetic structure 36 to create a fully symmetrical system (vertical and horizontal in FIG. 10) utilizing the inventive concept of reduced magnetic force and closer gapping with increasing lateral distance from the central magnets 35*a*, 36*a* to produce a configuration making more efficient use of magnetic material.

In all of the embodiments utilizing the magnet spacers 44*s* or 45*s* these spacers can be ferrous or non-ferrous and they may also be a separate spacer or may be functionally satisfied by being a formed part of support structure 30*a* or 30*b* that serves the same function as the spacer shown. Again, using a ferrous metal provides a flux return path in alternating pole magnet row configurations and can give an additional advantage in useable magnetic field energy.

In another embodiment, which can be configured as shown in FIGS. 3–10, or as configured in the remaining drawing figures, to a more or less fill extent depending on geometric factors, instead of orienting the magnets so that the poles are oriented so as to align pole to pole with lines normal to the supporting structure 30, the magnets can be rotated 90 degrees so as to be aligned pole to pole with lines parallel to the supporting structure. When the magnet rows are arranged in alternating polarity flux return paths are formed from areas adjacent two facing N poles to areas adjacent facing S poles, and shared loop field strength maxima are located over each magnet, and local loop maximal are located adjacent the facing pole pairs of the same polarity across the inter-magnet spaces 16. An example can be seen with reference to FIG. 36, discussed further below.

As can be appreciated from the embodiments discussed above and seen in the above-discussed drawing figures, the approach of providing a secondary magnetic structure with a magnetic field strength which varies laterally from a central portion can be accomplished a number of ways, some of which are, i) using high energy, neodymium magnets in the central portion and lower energy magnets, such as ferrite magnets, at the outer regions; ii) using larger and/or deeper high energy magnets in the central region while using smaller and/or shallower magnets in the outer regions, with those in the outer region spaced closer to the diaphragm 21; iii) using a lower number of magnet rows, and grouping them more centrally in the secondary magnetic structure, as compared with the primary structure, or some combination of the approaches.

The outer magnets may themselves be of smaller size, and/or of lower total energy capability than the central magnets but by moving them closer to the diaphragm they may produce the same, or more, or less, magnetic field strength in the actual plane of the diaphragm where the conductive strips 27 of the coil are located, than the central magnets of greater total field strength.

Alternatively, although the economical gains may not be as advantageous, more elongated conductive runs 27 i.e. coil "turns" could be placed on or in the diaphragm near the central row(s) of magnets and fewer conductive runs could be placed near the laterally outer-most magnet rows to create greater forces in the center and lower forces towards the outside. This approach can be combined with the foregoing concepts in varying the force available to move the diaphragm with position across the diaphragm.

Also, it should be clear that the magnetic distribution of greater magnetic strength in the central magnets compared to the outer magnets could be due to magnet count, magnet mass, magnet/diaphragm gap distance, or other constructs that are known in the art to affect magnetic strength in a magnetic circuit.

Moreover, while the concept has been discussed in connection with cross-sectional figures, in terms of a single transverse plane, in another embodiment the magnet strength can be varied in a transverse plane. That is to says, moving along the magnet rows in and out of the planes of the figures discussed above, the magnet energy, magnet face-to-diaphragm gap, inter-magnet spacing, etc. can be varied as well, so that looking at a speaker from the front the magnetic field set up by the magnetic structure varies with distance from the center of the diaphragm both in a vertical and a horizontal direction.

To reiterate, increasing magnetic energy in the central area or region and decreasing gap distance between the magnets and the diaphragm 21 at the outer vibratable diaphragm 21 areas or regions can provide the most acoustical efficiency with the least amount of magnetic expenditure and/or provide performance levels virtually unachievable with an equal magnetic energies all across the transducer. Again, the potential reachable with this concept utilizing high energy magnets, for example of greater than 25 mGO and even preferably greater than 34 mGO, such as is achievable in using neodymium magnets for at least a central portion of these transducers, is found to be superior than that of prior single-ended planar-magnetic transducers.

Figure 11:
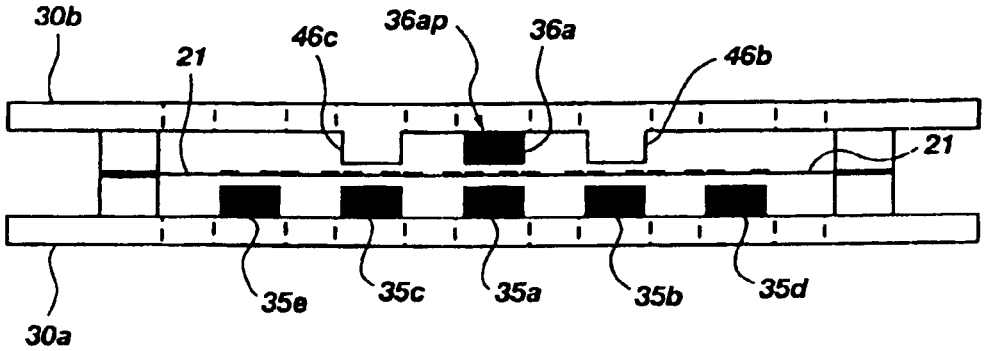
FIG. 11 is a cross-sectional view of an embodiment of the invention with asymmetrical magnetics combined with virtual magnetic poles.

With reference to FIG. 11, the illustrated embodiment introduces the concept of using a ferrous material for at least the secondary support structure 30*b* and optionally for the primary support structure 30*a* as well, wherein support structure 30*b* is constructed to include virtual magnetic poles 46*b* and 46*c*. The virtual poles can be thought of as replacements for magnets 36*b* and 36*c* of lesser energy such as used in the secondary magnetic structure 36 of the embodiment shown in FIG. 9. These virtual poles return the flux at the polarity of the surface side 36*ap* of magnet row 36*a* that is in contact with support structure 30*b* to their faces adjacent the diaphragm 21. This would either be a north or south polarity of the magnet, with the opposite polarity again facing the diaphragm 21. These virtual poles 46*b* and 46*c* can be an integral part of support structure 30*b* or be separate ferrous parts attached to support structure 30*b*. In one embodiment it is a consideration that these virtual poles be positioned closer to the diaphragm 21, with a smaller gap distance 31 to the diaphragm, than the magnet 36*a* in the center. This is because their field strength will have some loss compared to that of an actual magnet being used in the same position. This is consistent with the previous approaches, disclosed above, of tapering the magnetic strength, and also closing the gap to the diaphragm moving laterally from the center outward towards the outer parts of the diaphragm. An example can be seen in the secondary magnetic structure 36 of the embodiment shown in FIG. 13. As before discussed larger holes 15*b* can be used in the secondary support structure for improved high-frequency performance characteristics.

Figure 12:
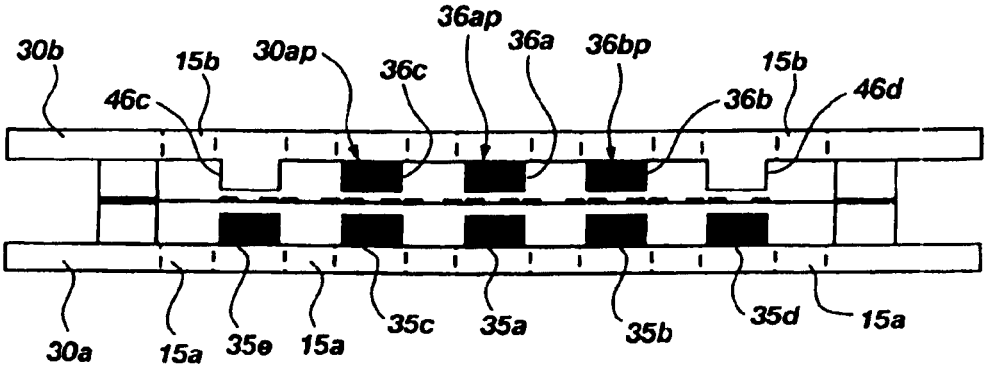
FIG. 12 is a cross-sectional view of another embodiment of the invention with asymmetrical magnetics combined with virtual magnetic poles.

Turning now to FIG. 12, the illustrated embodiment employs the same concept of virtual poles as that of FIG. 11, but now employs 3 magnets 36*a*, 36*b*, and 36*c* combined with two virtual poles 46*d* and 46*e* in the secondary magnetic structure 36. As mentioned above, in one embodiment the virtual poles 46*d* and 46*e* can both be configured to have closer gaps 31 than the magnets 36*a, b,* and *c*. These virtual poles return the polarity of the surface sides 36*bp* and 36*cp* of magnet rows 36*b* and 36*c* that are in contact with support structure 30*b*. These surface sides 36*bp* and 36*cp* are of the same magnetic polarity, which is the opposite of the polarity 36*ap* of central magnet 36*a*.

Figure 13:
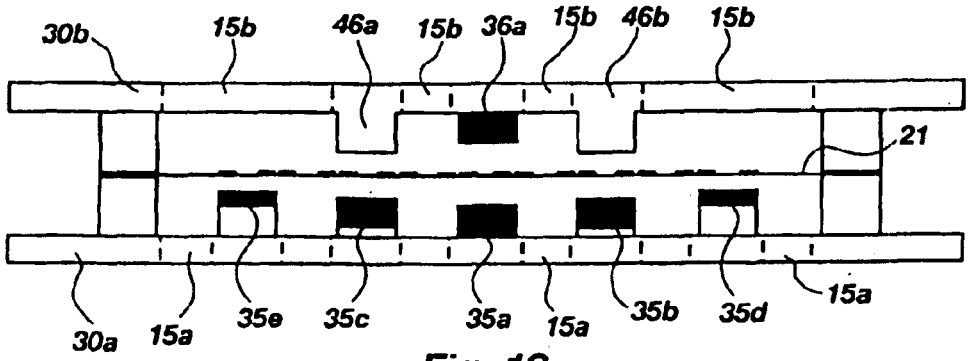
FIG. 13 is a cross-sectional view of an embodiment of the invention with asymmetrical magnetics combined with virtual magnetic poles and varied magnetic gaps.
Figure 14:
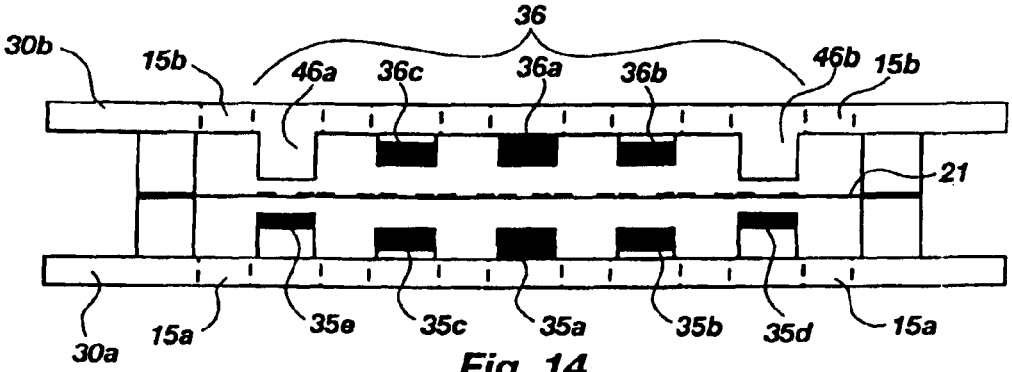
FIG. 14 is a cross-sectional view of another embodiment of the invention with asymmetrical magnetics combined with virtual magnetic poles and varied magnetic gaps.
Figure 15:
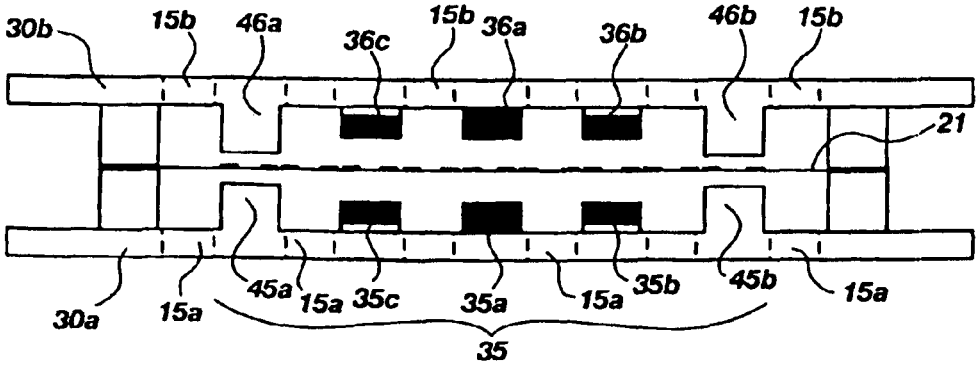
FIG. 15 is a cross-sectional view of still another embodiment of the invention with asymmetrical magnetics combined with virtual magnetic poles and varied magnetic gaps.

With reference to FIG. 13, the illustrated embodiment can be seen to combine the features of the virtual poles of FIG. 11 with the concept of variable gap 31 on the secondary magnetic structure side of the diaphragm 21 and with the variable primary magnetic structure 35 energy distribution of the embodiments illustrated in FIGS. 4–10 and discussed above. With reference to FIG. 14, the illustrated embodiment can be seen to combine the features of the virtual poles of the embodiment shown in FIG. 12 with the concept of a primary magnetic structure 35 energy distribution of FIGS. 4–10 which varies with lateral distance from a central portion of the diaphragm. In another embodiment shown in FIG. 15, the design uses the secondary magnet structure 36 configuration of FIG. 14 discussed above, and mirrors it in the primary magnetic structure 35. In this respect the concept is similar to that of the embodiment shown in FIG. 10 above, but using virtual poles 45*a*, 45*b*, 46*a*, and 46*b*. Again, with these embodiments, as well as the others discussed herein, further alterations can be made, for example such as varying the number of coil turns (conductor 27 runs) per magnet/virtual pole, or varying the energy, shape (mass), constituent material, etc. of the magnets and/or varying the configuration of the polarities, or the configuration of the virtual poles, etc. to further provide variation in force available to move the diaphragm at various locations across the diaphragm 21 as discussed above.

Figure 16:
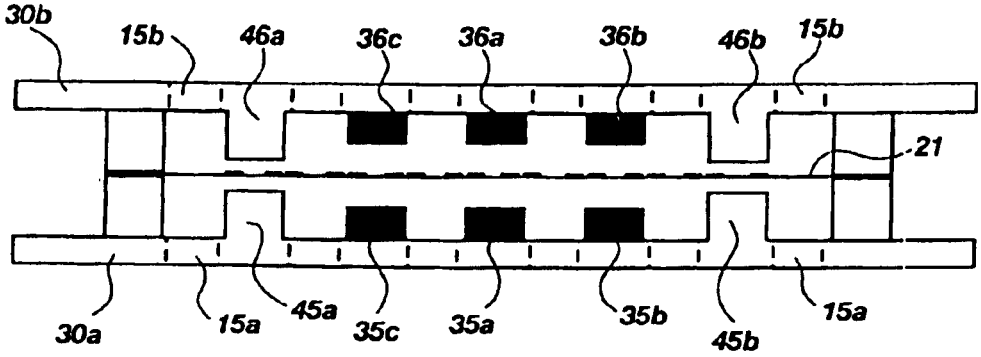
FIG. 16 is a cross-sectional view of another embodiment of the invention with asymmetrical magnetics combined with virtual magnetic poles and varied magnetic gaps.
Figure 17:
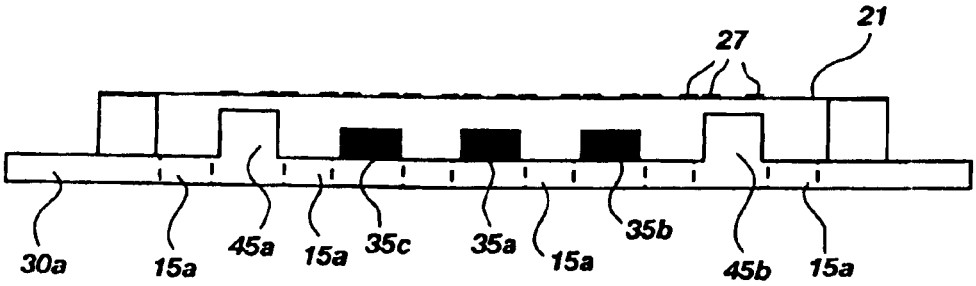
FIG. 17 is a cross-sectional view of an embodiment of the invention with single-ended magnetics combined with virtual magnetic poles and varied magnetic gaps.
Figure 18:
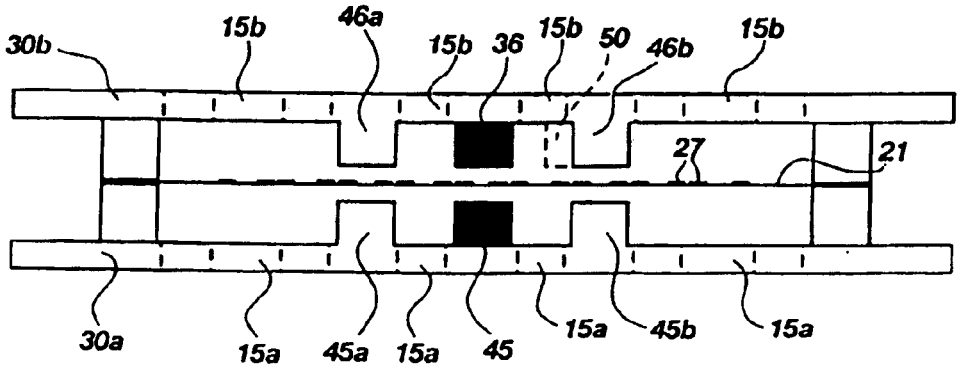
FIG. 18 is a cross-sectional view of an embodiment of the invention with single rows of double-ended magnetics combined with virtual magnetic poles with smaller magnetic gaps.
Figure 19:
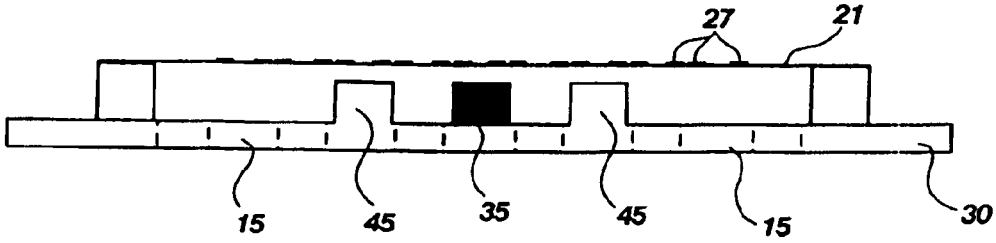
FIG. 19 is a cross-sectional view of an embodiment of the invention with single row of single-ended magnetics combined with virtual magnetic poles with smaller magnetic gaps.

FIGS. 16 through 19 show various combinations of virtual poles 45, 46 and magnets 35*a*, 35*b* to create different magnetic circuits that provide advantageous use of magnetic material. Generally, the embodiments shown in these illustrations teach that the virtual poles are used to the outside of the central magnet 35*a*, 36*a*, again in keeping with the principle of decreasing energy moving from center laterally outward. In these embodiments a magnet is not positioned further outside of the virtual pole. However, a magnet of low energy could be so placed consistent with this disclosure of decreasing the energy in the magnetic structure(s) moving outward. Also, the virtual poles 45*a,b*, 46*a,b* farther outside from center typically have a closer gap 31 than the adjacent magnet(s) closer to the center. These embodiments are configured as single-ended (FIGS. 17, 19) or as single ended with mirror-image secondary magnetic structures 36 (FIGS. 16 and 18). In each latter case the secondary structure 36 is configured with poles or virtual poles of decreasing energy moving outward from center. Other horizontal-axis non-symmetrical and symmetrical (quasi-push pull) embodiments are also possible, as will be appreciated from the examples given. With respect to FIG. 18, nonsymmetrical embodiments can include those pulling the virtual poles closer (e.g. 50) to form vertical axis non-symmetry but vertical axis symmetry, or pulling one virtual pole on one side closer to form a configuration that is nonsymmetrical with respect to a vertical central axis.

Figure 20:
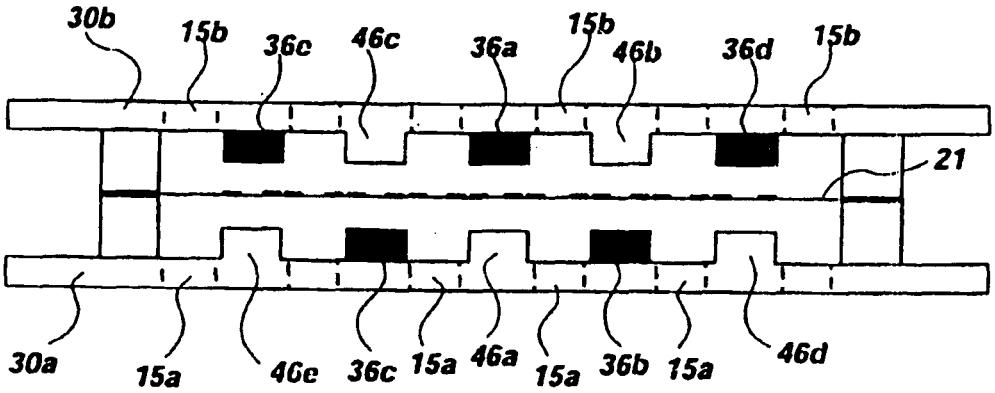
FIG. 20 is a cross-sectional view of an embodiment of the invention with asymmetrical magnetics including alternating virtual magnetic pole.
Figure 21:
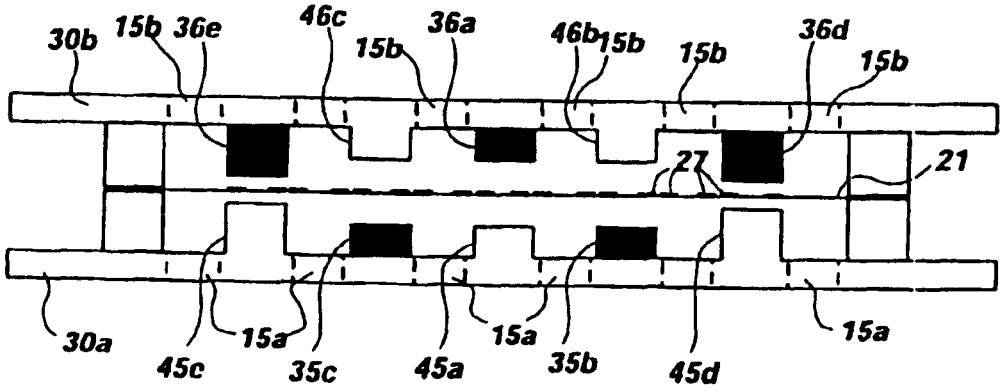
FIG. 21 is a cross-sectional view of an embodiment of the invention with asymmetrical magnetics including alternating virtual magnetic poles and varied magnetic gaps.

FIGS. 20 and 21 show asymmetrical double-ended structures that combine virtual poles 45, 46 with actual magnets 35, 36 alternating across the transducer. Each magnet is across from a virtual pole; however, some configurations may allow for offset orientations 50 (see FIG. 18) to achieve special field orientations. FIG. 21 differs in that the outer most magnets 35*b*, 35*c*, 36*d* and 36*e* and the outermost virtual poles 46*b*, 46*c* 45*d* and 45*e* all have closer gaps than the central magnet 36*a* and central virtual pole 45*a*.

Figure 22:
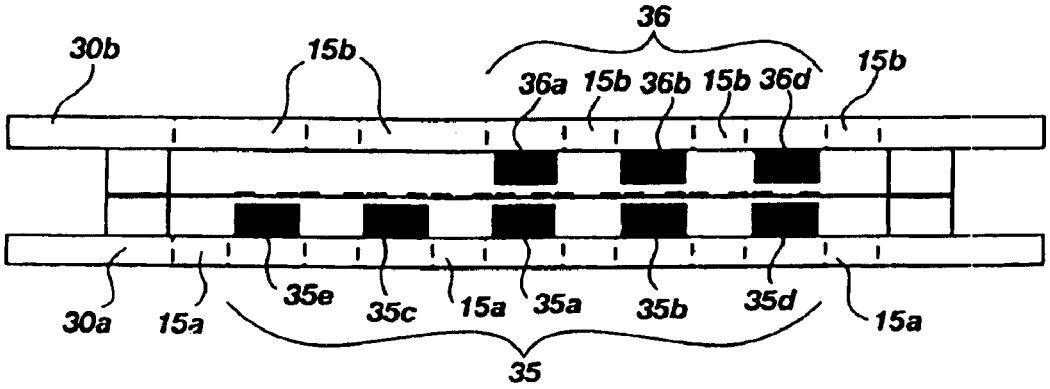
FIG. 22 is a cross-sectional view of an embodiment of the invention with asymmetrical magnetics including double-ended magnetics for high frequencies.

FIG. 22 shows a single-ended magnet structure 35 combined with an asymmetrical secondary magnet structure 36 which is used to enhance a smaller, specific region on the diaphragm, for example one dedicated to include high frequency output. Since the region is smaller it can use the extra magnets to increase output to make up for smaller size.

Figure 23:
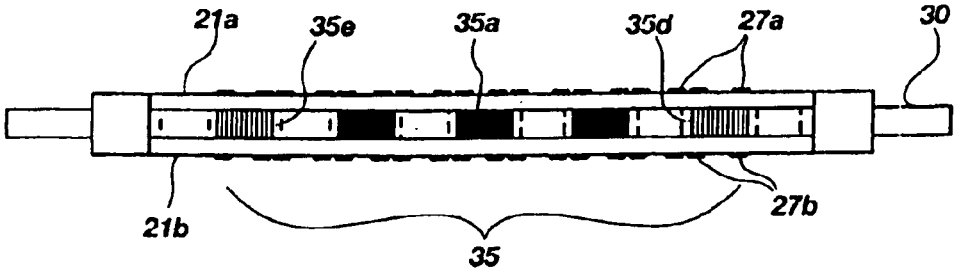
FIG. 23 is a cross-sectional view of an embodiment of the invention with dual diaphragms bounding each side of a primary magnetic circuit with lower energy magnets in the outer rows.
Figure 24:
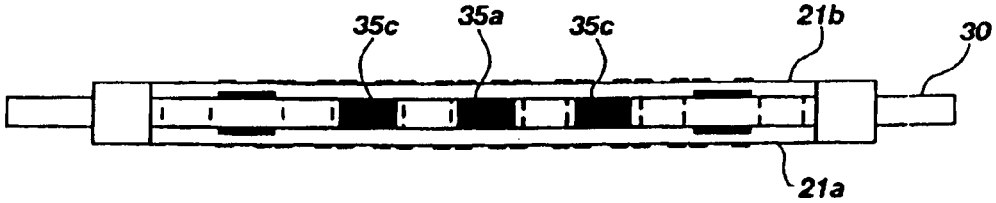
FIG. 24 is a cross-sectional view of an embodiment of the invention with dual diaphragms bounding each side of a primary magnetic circuit with smaller, closer gapped magnets in the outer rows.
Figure 25:
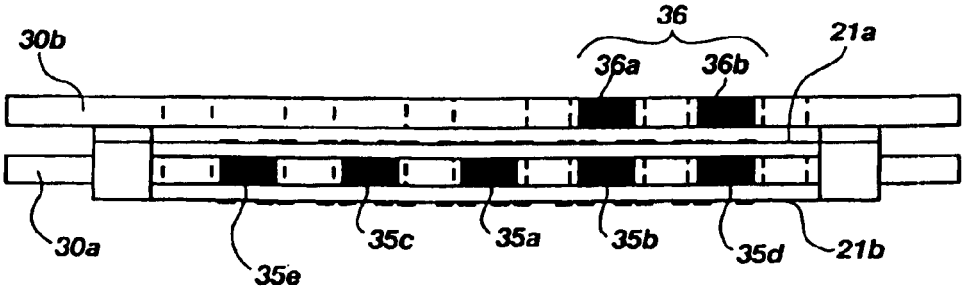
FIG. 25 is a cross-sectional view of an embodiment of the invention with dual diaphragms bounding each side of a primary magnetic circuit with secondary magnets to enhance the output of a high frequency section of the transducer.

FIGS. 23, 24 and 25 all use a primary magnet structures 35 with multiple diaphragms 21*a* and 21*b*, with conductive runs 27*a* and 27*b*, said diaphragms placed on each side of the magnets. This could be characterized as virtual secondary magnetic structure, as the field strength of the coils is augmented (e.g. doubled) rather than augmenting the stationary magnetic field from a primary magnetic structure by adding a secondary one. FIG. 23 shows magnets 35*d* and 35*e* which are a lower energy magnets than central magnet 35*a*. Central magnet 35*a* may be of neodymium composition and the outer magnets 35*d* and 35*e* may be of lower energy ferrite composition.

FIG. 25 adds a secondary magnet structure 36 to enhance a high frequency area of diaphragm 21*a* similar to addition of secondary magnet structure 36 in FIG. 22.

Figure 26:
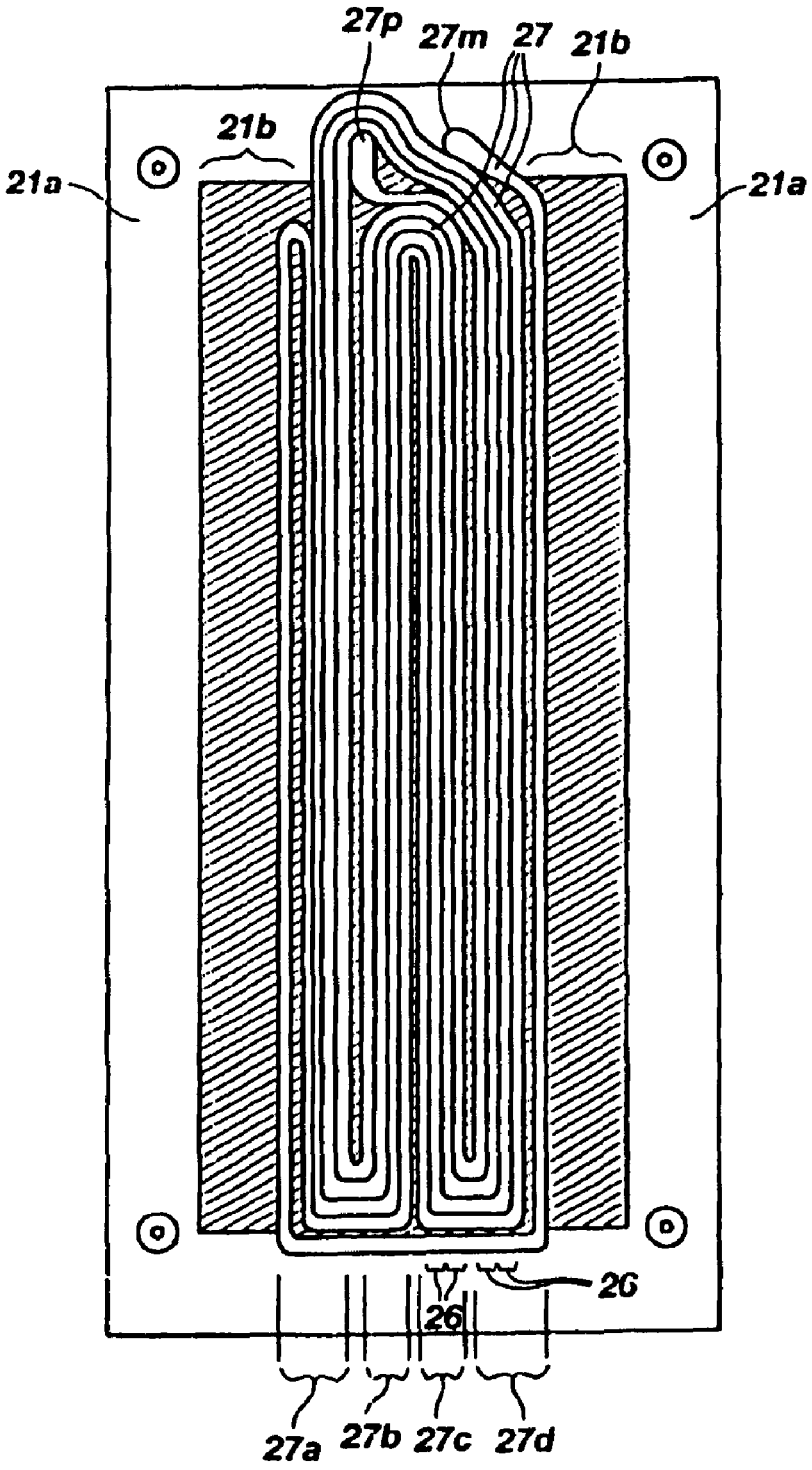
FIG. 26 is a face view of an embodiment of an image of the vibratable diaphragm of the invention.

FIG. 26 illustrates a diaphragm 21 in one embodiment with conductive regions 26 made up of individual elongated conductive runs 27. Groups of 4 conductive runs, 27*a*–27*d*, in a preferred embodiment could also be further optimized by having the left and right pairs, in each group of four, be separated by about half the distance that each group of four is spaced from each other. Each group of four runs is associated with, and centered over, a pair of adjacent magnets of different polarity relationship. The input ends of 27*p* and 27*m*, of the conductive regions 26, are adapted to be electrically terminated to receive the incoming audio signals. Terminal area 21*a* is the general area of attachment and area 21*b* is the outer portion of the active area 25, not directly driven by the conductive regions and in some embodiments, preferably damped by a viscous damping medium.

This FIG. 26 represents the aluminum conductive regions 26 which would be attached to diaphragm 21, preferably composed of PEN film, with the adhesive preferably being a cross linked adhesive.

Figure 27:
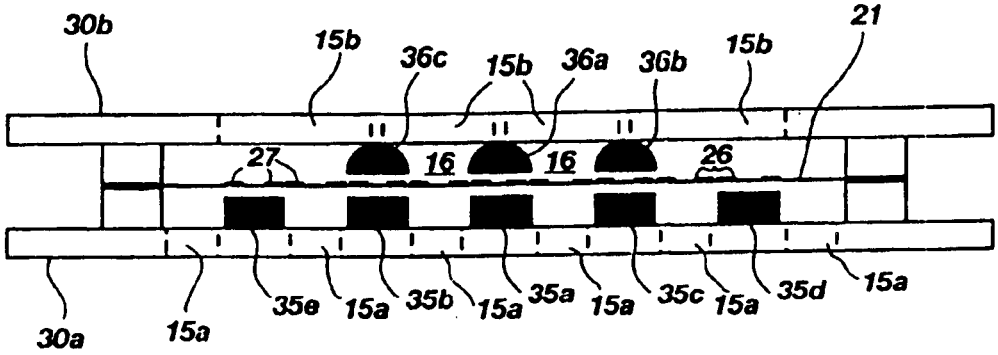
FIG. 27 is a schematic crossectional view of another embodiment of the invention.
Figure 28:
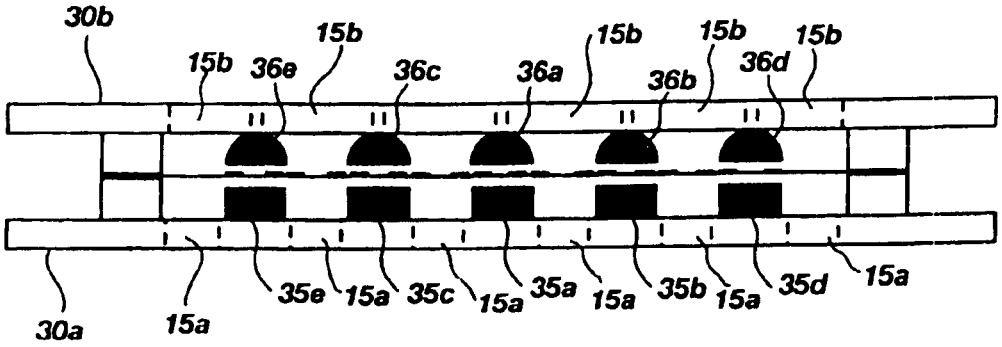
FIG. 28 is a schematic crossectional view of another embodiment of the invention.
Figure 30:
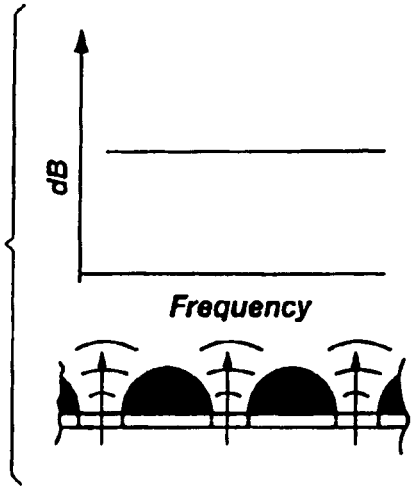
FIG. 30 is another illustration comparing inter-magnet space geometry with frequency response.
Figure 29:
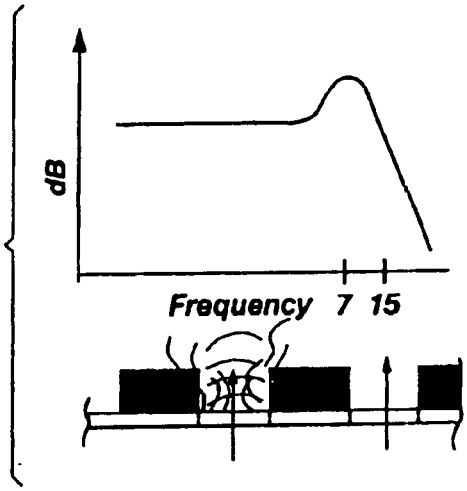
FIG. 29 is an illustration comparing inter-magnet space geometry with frequency response.

With reference now to FIGS. 27 and 28, in another embodiment the magnets 36*a–c,* 36*a–e* of the secondary magnetic structure 36 are shaped to be narrow at the base, providing a flare or horn shape to the opening between the magnets on the secondary structure side. The holes 15*b* in the secondary support structure 30*b* are made larger as well. This configuration results in a flatter higher frequency response, and opens the secondary structure side, enabling improved performance. High energy magnets can be formed in this manner, and so the advantages of high-energy magnets discussed above can be combined with the shape to further enhance performance. As with the other embodiments discussed above, magnet strength, gap 31 spacing, coil turns, etc. can be varied as discussed above to obtain further efficiencies and improved performance. Comparisons of frequency response for rectilinear and flared inter-magnet space configurations are illustrated in FIGS. 29 and 30.

With reference now to FIGS. 31A–F further embodiments illustrate different magnet shapes and combination with support structure opening configurations to provide shaped inter-magnet spaces which can improve performance. Rhombic shapes are not as advantageous from an acoustic perspective, but are cheaper and easier to use in manufacturing, generally. The shaping of the holes 15*b* in the secondary magnetic structure to continue the flare of a horn shape adds to cost but does improve the acoustic performance to some degree.

Figure 32:
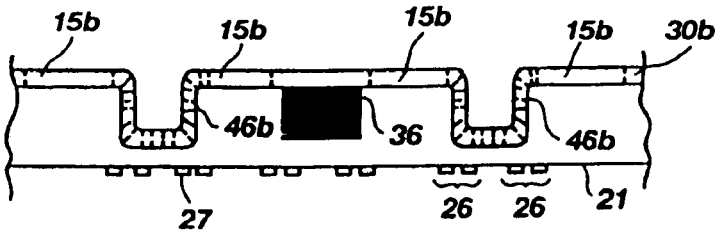
FIG. 32 is a schematic crossectional view of another embodiment including perforated virtual poles which can be used as either a primary or secondary magnetic structure.
Figure 33:
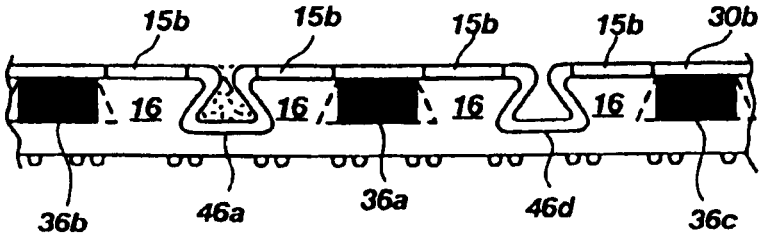
FIG. 33 is a schematic crossectional view of another embodiment including shaped virtual poles, and alternate shapes for the magnets shown in outline defining flared inter-magnet spaces and openings in the supporting structure, the configuration being useable as a primary or secondary magnetic structure.
Figures 31A, 31B, 31C, 31D, 31E, 31F:
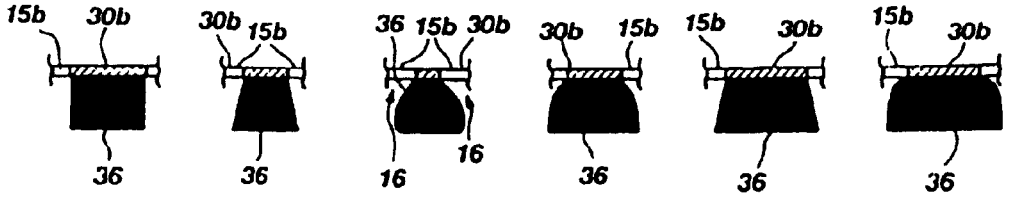
FIGS. 31*a* through *f* are schematic crossectional views of various magnet shapes.
Figure 34:
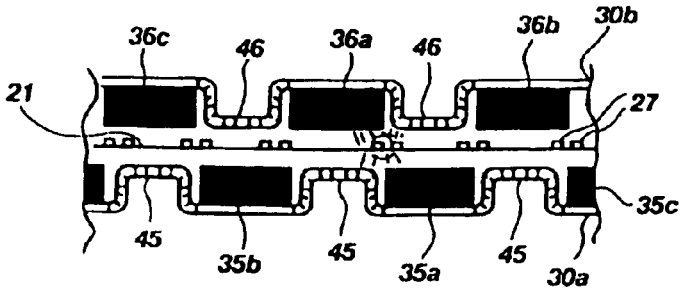
FIG. 34 is a schematic crossectional view of another embodiment including perforated virtual poles and overlapping local and shared magnetic field line loops; and, FIG. 35 is a schematic crossectional view of another embodiment, a possible secondary magnetic structure being shown in outline.
Figure 35:
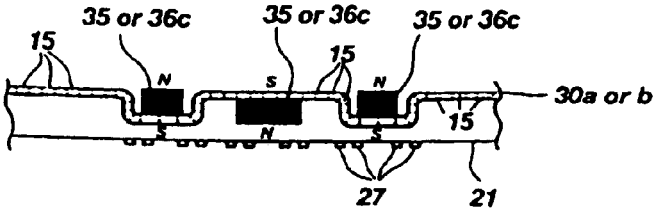

With reference to FIGS. 32 and 33, in other embodiments a virtual pole 46 can be made by forming the support structure 30*a* or 30*b* in a folded configuration, for example by a roll-forming process. The virtual pole thus formed can have a substantially rectilinear configuration, as in FIG. 32, mimicking the shape of a rectilinear section magnet. Further, the virtual pole can be perforated to allow it to be more easily formed, and to allow some acoustic transparency. Holes 15 in the supporting structure can also be provided. With reference to FIG. 33, the folded structure virtual pole can mimic a shaped magnet, to provide a flared inter-magnet space 16. Again, holes are provided in the support structure as described above to allow passage of sound (and air) with less restriction and the attendant audio artifacts of restriction. In one embodiment the folded virtual pole can be filled with an epoxy, which can contain a ferrous material, to improve the magnetic circuit performance and also stiffen the support structure. In another embodiment, shown in FIG. 34, The virtual poles 45, 46 are formed of perforated support structure 30*a,b* plate, and the magnets 35, 36 spaced closely between. The magnets are all of the same polarity in each of the primary magnetic structure and the secondary structure, so that the virtual poles are of opposite polarity to the magnets. This configuration can be combined with the other features of variation of magnet energy and gap 31 width, and can be made mirror image or offset (as shown in the figure). The latter has the advantage of providing a magnet which has a higher energy adjacent a virtual pole having a lower energy. With reference to FIG. 35, in another embodiment similar to FIG. 32 a magnet 35 or 36 is placed in an otherwise empty virtual pole of folded configuration and enhances the energy of the pole. As will be appreciated, the configuration of FIG. 35 can also be used to create each magnet row, and can be reversed. This is further illustrated in FIG. 36, where the folded support structure is used to hold the magnets and to cooperate with the shape of the magnets to provide flared inter-pole openings 16 adjacent the holes 15 in the structure in one embodiment.

Figure 36:
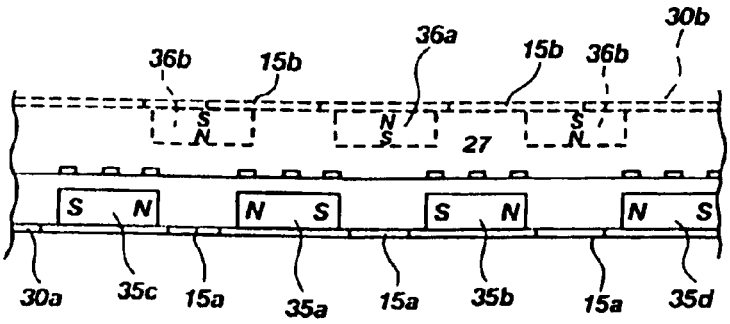
FIG. 36 is a schematic crossectional view of another embodiment incorporating flared inter-pole openings.

With reference to FIG. 36, in another embodiment the magnets 35*a,b* are oriented 90° from those of the other embodiments, and the conductor areas 26 comprising conductor strips 27 of the coil are located adjacent and overtop the magnets.

With respect to all the embodiments the configuration of the holes 15 can be varied also. The holes can be round, elongated and rounded at the ends, ovals, rectilinear, or another shape complimenting the other aspects of the particular embodiment. It has been found that using higher-strength magnets (e.g. >25 mGO) in combination with maximizing local loop interaction and opening up the inter-magnet spacing gives improved performance enabling commercially competitive devices, and the configuration of the magnets, support structure, and the openings therein, can be further manipulated to enhance performance in addition to the other improvements disclosed herein. As discussed, variation of gap spacing, inter-magnet spacing, magnet energy, coil conductor placement, and other parameters, such as size and tension of the diaphragm, for example, in combination with these novel constructions enable performance and sizes of transducers heretofore not deemed achievable for practical implementation of planar-magnetic technology.

It is evident that those skilled in the art may now make numerous other modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and not limited to the examples given herein, as it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, no limitation of the scope of the invention is intended.

What is claimed is:

1. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

primary magnetic structure including at least three elongated magnets placed adjacent and substantially parallel to each other, said magnetic structure configured to cooperate with the conductive surface area conducting an electrical signal to actuate the active region to produce an acoustic output;

a mounting support structure coupled to the primary magnetic structure and the diaphragm to capture the diaphragm, hold it in a predetermined state of tension and space it at predetermined distancing the primary magnetic structure adjacent one of the surface sides of the diaphragm;

said conductive surface area including elongate conductive paths running substantially in parallel with said magnets;

the mounting support structure, the at least three magnets of the primary magnetic structure, and the diaphragm having coordinated compositions and being cooperatively configured and positioned in predetermined spaced apart relationships wherein (i) the mounting support structure stabilizes the diaphragm in a static configuration at the predetermined tension which remains stable over and between extended periods of use, despite occurrence of dynamic conditions in response to extreme high energy forces driving the diaphragm to audio output, and (ii) the high energy magnetic forces interacting between the at least three magnets do not interfere with the predetermined tension of the diaphragm;

at least one secondary magnet structure positioned adjacent to the opposite surface of said thin film diaphragm from the primary magnet structure and spaced a predetermined distance from said diaphragm;

said secondary magnet structure being directly adjacent less diaphragm surface area than said primary magnet structure, said transducer being configured so that the secondary support structure has a more open architecture and significantly more open space than the primary support structure, allowing passage of acoustic energy with significantly less interference from the secondary support structure than the primary support structure and wherein a plurality of elongated magnets of the primary magnetic structure are without corresponding magnets of opposing position in the secondary magnetic structure, the transducer thereby configured to have an essentially single-ended configuration over a portion of the diaphragm;

said planar-magnetic transducer being operable as an enhanced single ended transducer.

2. The planar-magnetic transducer of claim 1 wherein said secondary magnetic structure is less than 60 percent of the magnets of the primary magnetic structure.

3. The planar-magnetic transducer of claim 1 wherein said secondary magnetic structure is less than 40 percent of the magnets of the primary magnetic structure.

4. The planar-magnetic transducer of claim 1 wherein said secondary magnetic structure is no more than 20 percent of the magnets of the primary magnetic structure.

5. The planar-magnetic transducer of claim 1 wherein said secondary magnetic structure has one row of magnets centered side to side on the planar-magnetic transducer.

6. The planar-magnetic transducer of claim 1 wherein said primary magnetic structure is the backside of the transducer and the secondary magnetic structure is the front of the transducer optimized to be oriented toward the listening position.

7. The planar-magnetic transducer of claim 6 wherein said secondary magnetic structure comprises high energy neodymium magnets.

8. The planar-magnetic transducer of claim 1 wherein said primary magnet structure has five adjacent rows of magnets and said secondary magnet structure has three adjacent rows of magnets.

9. The planar-magnetic transducer of claim 1 wherein said primary magnet structure has five adjacent rows of magnets and said secondary magnet structure has one central row of magnets.

10. The planar-magnetic transducer of claim 1 wherein said secondary magnetic structure comprises high energy neodymium magnets.

11. A transducer as set forth in claim 1, wherein the magnets of the secondary magnetic structure are concentrated over a part of the active area, and a part of the active area has no magnets adjacent in the secondary magnetic structure.

12. A transducer as set forth in claim 11, wherein the magnets of the secondary magnetic structure are positioned in a central portion of the active area between two edges thereof.

13. A transducer as set forth in claim 1, further comprising a virtual pole.

14. A transducer as set forth in claim 1, wherein available magnetic energy is greater toward a central portion of the diaphragm and decreases toward edges thereof in at least one dimension.

15. A transducer as set forth in claim 14 wherein differing magnet strength is derived from at least one of: a) volume of magnetic material; b) a difference in magnetic material; and c) use of virtual poles.

16. A transducer as set forth in claim 1, wherein a distance between the diaphragm and the primary magnetic structure can be less with increased distance outward from a central portion of the active area.

17. A transducer as set forth in claim 1, further comprising an additional diaphragm positioned so that the primary magnetic structure is intermediate two diaphragms.

18. A transducer as set forth in claim 1, wherein intermagnet spaces are shaped to improve transducer response.

19. A transducer as set forth in claim 1, wherein the support structure comprises virtual poles which are configured to be acoustically more transparent by means of perforations.

20. A transducer as set forth in claim 1, wherein an axis of polarity of least one magnet of at least one of the primary and the secondary magnetic structures is oriented 90 degrees from that of another magnet in the transducer.

21. A planar-magnetic transducer comprising:

at least one thin film vibratable diaphragm with a first surface side and a second surface side, including a predetermined active region, said predetermined active region including a predetermined conductive surface area for converting an input electrical signal into a corresponding acoustic output;

primary magnetic structure including at least three elongated magnets placed adjacent and substantially parallel to each other with at least one of said magnets being of higher energy than at least two others, with each elongated magnet having an energy product of greater than 25 mega Gauss Oersteds; and a mounting support structure coupled to the primary magnetic structure and the diaphragm to capture the diaphragm, hold it in a predetermined state of tension and space it at predetermined distancing from the primary magnetic structure adjacent one surface side of the film diaphragm;

said conductive surface area including elongate conductive paths running substantially in parallel with said magnets;

any of the at least three adjacent magnets being oriented to be of opposite polarity orientation in relation to an adjacent magnet;

said primary magnetic structure having at least three adjacent rows of side by side magnets with at least an outer two rows of the at least three rows of magnets providing less magnetic field strength through the conductive surface area of the diaphragm than provided through the conductive surface areas of the diaphragm by a center row of the magnets;

a secondary magnetic structure including at least one magnet row positioned adjacent to the opposite surface of said thin film vibratable diaphragm from the primary magnet structure and spaced a predetermined distance from said diaphragm, said secondary magnet structure being directly adjacent less diaphragm surface area than said primary magnet structure, said transducer being configured so that the secondary support structure has a more open architecture and significantly more open space than the primary support structure, allowing passage of acoustic energy with significantly less interference from the secondary support structure than the primary support structure and wherein a plurality of elongated magnets of the primary magnetic structure are without corresponding magnets of opposing position in the secondary magnetic structure, the transducer thereby configured to have an essentially single-ended configuration over a portion of the diaphragm;

said planar-magnetic transducer being operable as an enhanced single ended transducer.

22. The planar-magnetic transducer of claim 21, including at least five adjacent rows of magnets with at least two outer rows of said five rows of magnets providing less magnetic field strength through the conductive surface area of the diaphragm than provided through the conductive surface area of the diaphragm by a center row of magnets.

23. The planar-magnetic transducer of claim 21, wherein the primary magnetic structure includes neodymium magnets with an energy rating of at least 34 mGO.

24. The planar-magnetic transducer of claim 21, wherein:

said diaphragm has a central region and remote regions that are a distance away from said central region, said primary magnetic structure has central region magnets and adjacent remote magnets that are spaced away from said central region magnets, the predetermined spaced apart relationship of the diaphragm from the magnets of the primary magnetic structure being greater at a central region of the diaphragm over at least one central magnet than at the remote regions over at least one remote magnet.

25. The planar-magnetic transducer of claim 21, wherein said secondary magnetic structure has an energy that is less than 60 percent of that of the magnets of the primary magnetic structure.

26. The planar-magnetic transducer of claim 21, wherein said secondary magnetic structure has an energy that is less than that of 40 percent of the magnets of the primary magnetic structure.

27. The planar-magnetic transducer of claim 21, wherein said secondary magnetic structure has an energy that is no more than 20 percent of that of the magnets of the primary magnetic structure.

28. The planar-magnetic transducer of claim 21, wherein said secondary magnetic structure comprises one row of magnets centered in a side to side relationship on the active area of the vibratable diaphragm of said planar-magnetic transducer.

29. The planar-magnetic transducer of claim 21, wherein, said diaphragm has a central region and remote regions that are a distance away from said central region, said primary magnetic structure has central region magnets and adjacent remote magnets that are spaced away from said central region magnets, said diaphragm and the predetermined spaced apart relationship from the magnets of the primary magnetic structure are spaced such that the spaced apart relationship is greater at a central region of the diaphragm over at least one central magnet than the remote diaphragm regions over at least one remote magnet.

30. A transducer as set forth in claim 21, wherein the configuration of the magnetic structure and the conductive paths is such that the conductive paths are located adjacent areas of maximized flux density in the plane of the diaphragm, said areas being located off a center point between adjacent magnet rows and between the center point and a magnet row, the magnets being spaced far enough apart that there are two such maxima between each row of magnets.

31. A transducer as set forth in claim 21, further comprising at least one virtual pole.

32. A transducer as set forth in claim 21, wherein the center row provides more magnetic field strength by one of: a) larger volume of magnetic material; and, b) magnetic material having a different energy product.

33. A transducer as set forth in claim 21, wherein structure defining inter-magnet spaces is configured so that the inter-magnet spaces have a flaring shape.

34. A transducer as set forth in claim 21, wherein at least one magnet row has a polarity orientation wherein the north-south magnetic axis is parallel to a plane of the diaphragm.

35. A transducer as set forth in claim 21, wherein the support structure further comprises a perforated area having a multiplicity of small closely spaced perforations providing more acoustic transparency in that area.

36. A planar-magnetic transducer which includes:

a vibratable diaphragm and attached conducive area capable of interacting with a magnetic field to convert and audio signal to acoustic output from the diaphragm;

an arrangement of primary magnetic structure positioned proximate to one side of the diaphragm for providing a desired magnetic field; and at least one (but fewer that the all magnets comprising the primary magnetic structure) secondary magnet forming a secondary magnetic structure positioned on an opposing side of the diaphragm in a position which enhances acoustic output of the diaphragm, said secondary magnet structure being directly adjacent less diaphragm surface area than said primary magnet structure, said transducer being configured so that the secondary support structure has a more open architecture and significantly more open space than the primary support structure, allowing passage of acoustic energy with significantly less interference from the secondary support structure than the primary support structure and wherein a plurality of elongated magnets of the primary magnetic structure are without corresponding magnets of opposing position in the secondary magnetic structure, the transducer thereby configured to have an essentially single-ended configuration over a portion of the diaphragm;

and wherein the magnetic field strength is greater towards a central portion of an active area of the diaphragm between locations wherein the diaphragm is constrained from movement, and generally decreases moving away from a central portion outward toward edges of the active area in at least one dimension.

37. A transducer as in claim 36, further comprising at least one virtual magnetic structure positioned adjacent the secondary magnet and operable to further enhance the audio output of the transducer.

38. A transducer as set forth in claim 36, wherein over portions of the active area away from the diaphragm the primary magnetic structure and the diaphragm arc essentially operable as a single ended device, whereas over a central portion of the active area the device is operable as a double ended device.

39. A transducer as set forth in claim 36, further comprising a primary support structure carrying said arrangement of primary magnetic structure, and a secondary support structure carrying the at least one secondary magnet, and wherein the secondary support structure has a substantially more open architecture than the primary support structure, and wherein the secondary support structure can be disposed toward a listener and the primary support structure can be disposed away from a listener.

40. A transducer as set forth in claim 36, further comprising at least one virtual pole.

41. A transducer as set forth in claim 36, wherein the magnetic field strength is greater toward a central portion due to use of one of a) a different volume of magnetic material, b) a different strength magnetic material, and c) a virtual pole.

42. A transducer as set forth in claim 36, wherein a distance between magnetic structure and the diaphragm is greater adjacent a central portion of the diaphragm than that away from the central portion of the diaphragm.

43. A transducer as set forth in claim 36, comprising at least two diaphragms.

44. A transducer as set forth in claim 36, wherein the transducer is configured so that a shape of an inter-magnet space is configured to improve response of the transducer.

45. A transducer as set forth in claim 36, wherein a magnet of the primary magnetic structure is disposed so that it has a polarity orientation that is 90 degrees different from that of at least one secondary magnet.

46. A planar-magnetic transducer which includes:

a vibratable diaphragm and attached conducive area capable of interacting with a magnetic field to convert and audio signal to acoustic output from the diaphragm;

an arrangement of primary magnetic structure positioned proximate to one side of the diaphragm for providing a desired magnetic field;

at least one (but fewer that the all magnets comprising the primary magnetic structure) secondary magnet positioned on an opposing side of the diaphragm in a position which enhances acoustic output of the diaphragm;

and wherein the magnetic field strength is greater towards a central portion of an active area of the diaphragm between locations wherein the diaphragm is constrained from movement, and generally decreases moving away from a central portion outward toward edges of the active area in at least one dimension, wherein over portions of the active area away from the diaphragm the primary magnetic structure and the diaphragm are essentially operable as a single ended device, whereas over a central portion of the active area the device is operable as a double ended device.

47. A planar-magnetic transducer which includes:

a vibratable diaphragm and attached conducive area capable of interacting with a magnetic field to convert and audio signal to acoustic output from the diaphragm;

an arrangement of primary magnetic structure positioned proximate to one side of the diaphragm for providing a desired magnetic field;

at least one (but fewer that the all magnets comprising the primary magnetic structure) secondary magnet positioned on an opposing side of the diaphragm in a position which enhances acoustic output of the diaphragm;

and wherein the magnetic field strength is greater towards a central portion of an active area of the diaphragm between locations wherein the diaphragm is constrained from movement, and generally decreases moving away from a central portion outward toward edges of the active area in at least one dimension;

and wherein a distance between magnetic structure and the diaphragm is greater adjacent a central portion of the diaphragm than that away from the central portion of the diaphragm.

* * * * *